US007138916B2

(12) United States Patent
Schwartz et al.

(10) Patent No.: US 7,138,916 B2
(45) Date of Patent: Nov. 21, 2006

(54) COMPUTERIZED RISK MANAGEMENT PROGRAM

(76) Inventors: Jeffrey Schwartz, 77 Houston Pl., Haworth, NJ (US) 07641; Ernest Pasanen, 46 Old Farm Rd., Long Valley, NJ (US) 07853

( * ) Notice: Subject to any disclaimer, the term of this patent is extended or adjusted under 35 U.S.C. 154(b) by 221 days.

(21) Appl. No.: 10/696,296

(22) Filed: Oct. 29, 2003

(65) Prior Publication Data

US 2004/0095239 A1 May 20, 2004

Related U.S. Application Data

(60) Provisional application No. 60/421,894, filed on Oct. 29, 2002.

(51) Int. Cl.
*G08B 13/14* (2006.01)

(52) U.S. Cl. ..... 340/572.1; 340/573.4; 340/426.19; 340/438; 340/989; 701/213; 701/219

(58) Field of Classification Search ..... 340/572.1, 340/573.4, 426.19, 438, 989; 701/213, 219
See application file for complete search history.

(56) References Cited

U.S. PATENT DOCUMENTS

| | | | | |
|---|---|---|---|---|
| 5,825,283 | A * | 10/1998 | Camhi | 340/438 |
| 6,067,007 | A * | 5/2000 | Gioia | 340/426.19 |
| 6,072,396 | A * | 6/2000 | Gaukel | 340/573.4 |
| 6,453,238 | B1 * | 9/2002 | Brodie et al. | 701/216 |
| 6,507,786 | B1 * | 1/2003 | Flick | 701/213 |
| 6,737,989 | B1 * | 5/2004 | Flick | 340/989 |
| 2003/0104822 | A1 * | 6/2003 | Bentley | 455/456 |

* cited by examiner

*Primary Examiner*—Daniel Wu
*Assistant Examiner*—Samuel J. Walk
(74) *Attorney, Agent, or Firm*—Francis C. Hand; Carella,Byrne,Bain

(57) ABSTRACT

The computerized system provides a method to inventory articles, to locate lost or stolen articles and to recover a lost or stolen article. The system applies an electronic tag to each article of a multiplicity of articles or only to a valuable article and employs a computer to maintain an inventory of all articles. Use is made of a global positioning sysytem to locate a lost or stolen article as wel as to track movements of the article. A history of the movement of the article may also be plotted on a map. An electronic geographic boundary area may also be placed around an article that can be used to emit a signal indicative of the article leaving the area.

14 Claims, 19 Drawing Sheets

PADLOX tag it, track it, secure it.

contact us | site map

MY PADLOX | PRODUCTS | ABOUT PADLOX | GETTING STARTED | SUPPORT

PADLOCATOR | PADTAGS | PADFENCE | PADWORKS

PADFENCE

A PADFENCE is a feature that allows you to define the response of your PADTAG to either motion or a defined boundary. You can have the system automatically send a series of e-mails, faxes, telephone calls, pages, or any combination of these responses! There are presently three variations of the PADFENCE:

1. MOTION: This PADFENCE allows you to specify a speed, that if exceeded, will result in the automatic initiation of your predefined actions.
2. PERIMETER: This PADFENCE allows your to specify a boundary defined by the radius of a circle, centered on the preset location of an item. If this boundary is breached, your defined actions will be automatically initiated.
3. GEOGRAPHY: This PADFENCE will allow your to specify a defined, irregularly shaped area, such as a country or state, whose boundaries if breached will result in the initiation of your predefined actions.

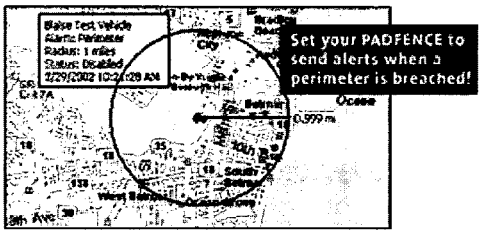

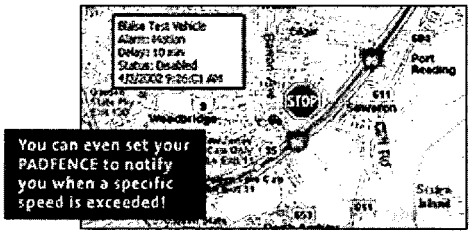

Copyright ©PADLOX 2002. All Rights Reserved. Privacy | Legal

FIG. 4

COMPUTERIZED RISK MANAGEMENT PROGRAM

This application claims priority of Provisional Application No. 60/421,894 filed Oct. 29, 2002.

This invention relates to a computerized risk management program and method for asset management and tracking.

The system employs the use of the Global Positioning System (GPS), the Internet, a unique software interface, a unique application software and unique tracking device firmware.

BACKGROUND OF THE INVENTION

The protection of valuables that are accumulated and used by businesses and individuals on a daily basis is of increasing concern. Over time, both individuals and businesses accumulate valuable assets that must be protected. Insurance attempts to shelter the financial effect of losses, but is not directly concerned with returning a missing item to its rightful owner. The accumulation of valuable and often times expensive items brings with it an element of risk.

In the past, the systems that have been offered to protect valuables have had significant weaknesses. A weakness of most systems, including central station monitored alarm systems, is that a missing item cannot assist in its own recovery. A second weakness is that systems have typically been passive, and rely on sound to foil or thwart an attempted theft. Additionally, these systems are totally dependent on law enforcement to recover a missing item. In large urban areas, law enforcement has too many other responsibilities and distractions to respond and actively pursue each theft.

Accordingly, it is an object of the invention to provide a system to obtain the recovery of a lost or stolen article.

It is another object of the invention to provide an economic sysytem of using a lost or stolen article to assist in the recovery of the article.

Briefly, the invention provides a method to inventory, locate and recover any protected item and is referred to herein as the PADlox system.

A protected item is one that has been equipped with the appropriate electronic tracking device.

A key element of the PADlox system is its ability to allow a missing or stolen item to assist in its own recovery. A combination of electronic tags and application software enables the owner to secure a protected item and to automatically have the item communicate an unwarranted attempt to move the item. Simply stated, the PADlox system is not a passive system. The typical alarm system relies on sound to thwart an attempted break-in. PADlox incorporates real time communication with application software working together to locate a missing item. Once a missing item has been located, law enforcement can effectuate recovery.

The PADlox system empowers the owner of a missing item with the ability to quickly and accurately locate that item from any Internet connection, anywhere in the United States. PADlox provides law enforcement with the information needed to recover the item.

The ways in which the protection provided by PADlox differs from conventional approaches is significant. The two must important elements of PADLox are:

(1) empowers the owner of a protected item with the ability to locate that item.

(2) allows the missing item to assist in its own recovery.

These and other objects and advantages of the invention will become more apparent from the following detailed description taken in conjunction with the accompanying drawings wherein:

FIG. 4 illustrates a computer display screen for establishing an electronic fence for a protected item in accordance with the invention;

THE PADLOX PROCESS

There are two major components to the PADlox system: (1) A software component called PADworks; and (2) a hardware component called a PADtag.

The Software Component: PADworks

To provide a mechanism that an individual or a business can employ and rely to protect valuable assets, requires that the assets are inventoried and documented. The PAD/ox process includes a component called PADworks, a software program that allows businesses or homeowners to create and maintain an inventory of the valuable contents of their homes or businesses.

Figure 1:
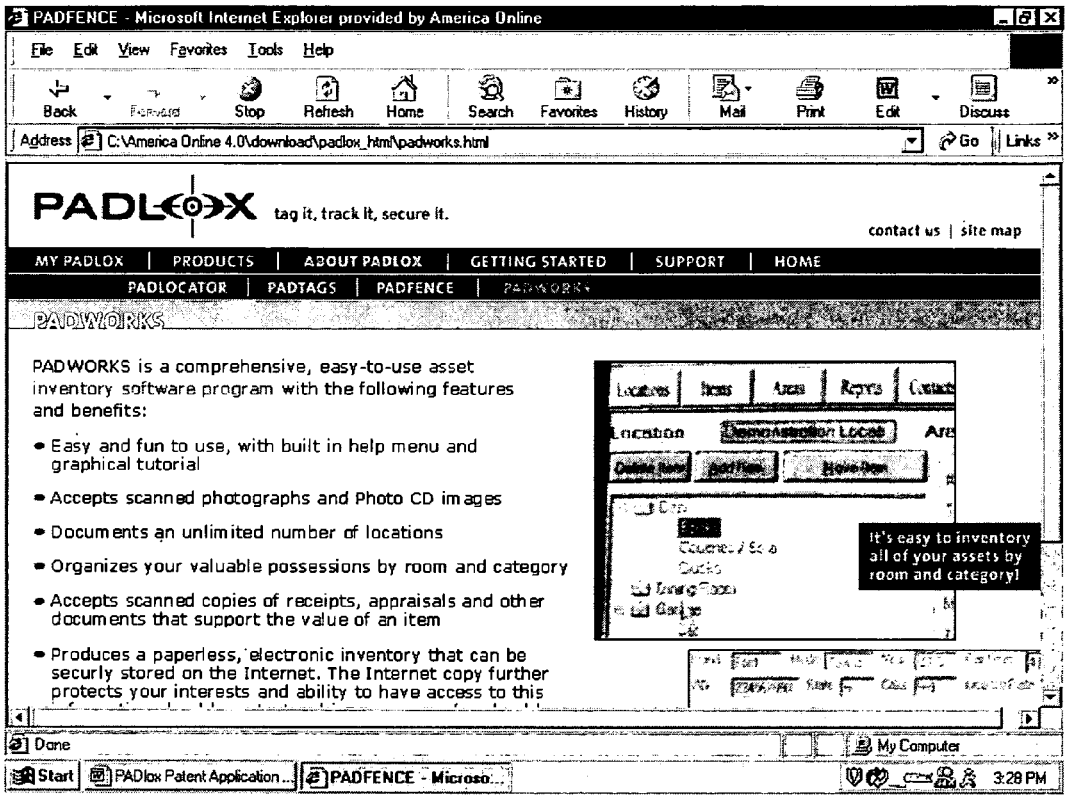
FIG. 1 illustrates a front page of a PADlox system displayed on a computer screen in accordance with the invention.

Referring to FIG. 1, PADworks begins by allowing the business or homeowner to define all of the areas (rooms) that are associated with a specific location (address). PADworks provides a list of suggested areas (i.e. kitchen, bedroom) from which "areas" can easily be selected. PADworks supports the documentation of multiple locations (addresses) within a single business or a single homeowner.

Within each area of each location, the user can document the contents of that area. The documentation of the contents of an area takes the form of a text list of each of the items located within each area. PADworks provides a list of suggested items for each "standard" area (i.e. kitchen, living room, etc) from which items can easily be selected. In addition, the user can enter the name of any atypical item for any area.

Toward the goal of providing adequate documentation, PADworks supports the user of digital photography and scanning. These two technologies allow the owner of the items to store both photographs and digital images of documents relating to each item. For example, if someone has a chandelier, the documentation could include photographs of the chandelier and also images of the invoice, cancelled check and/or appraisal or any other document that supports the value of the chandelier. Each photograph can be annotated with recorded, verbal comments related to that item. This type of documentation is invaluable in the unfortunate instance where an item is lost and not recovered. The insurance claim settlement process will be less stressful and result in a much fairer settlement with this type of detailed documentation.

Finally, PADlox system allows the user to locate any protected item in the inventory using the global positioning system and the Internet. The value of PADlox in this regard is obvious. Imagine that you could place on each and every item you owned, the electronics required to locate that item in the event of loss. Each item, so protected, would have the equivalent of an associated telephone number, in order to locate it. This would require a list of items and associated telephone numbers in order to be able to locate a missing item. This would not be a small task. Relating this need to PADworks allows the owner of a protected item to store the item's associated telephone number within the PADworks documentation. Using PADworks, after identifying the item to be located, the user merely selects the LOCATE function within the PADworks application. Essentially, the ability to locate a protected item is integrated into a function that most businesses and individuals understand: namely the need to provide adequate documentation for insurance purposes.

PADworks is available as both a desktop application whose data files can be uploaded to the Internet for use with an Internet based version of the same software. The process is bidirectional, in that the Internet based database can be downloaded to the desktop, for use with the desktop application. The Internet version of PADworks adds the tracking dimension to the PADworks documentation effort.

The PADlox Internet based application is designed to provide the answer to three questions about the movement of any protected item:

(1) Where is the protected item now?
(2) Where has the protected item been?
(3) Where is the protected item going?

Three views of the data are provided in order to answer each of the above questions.

Figure 2:
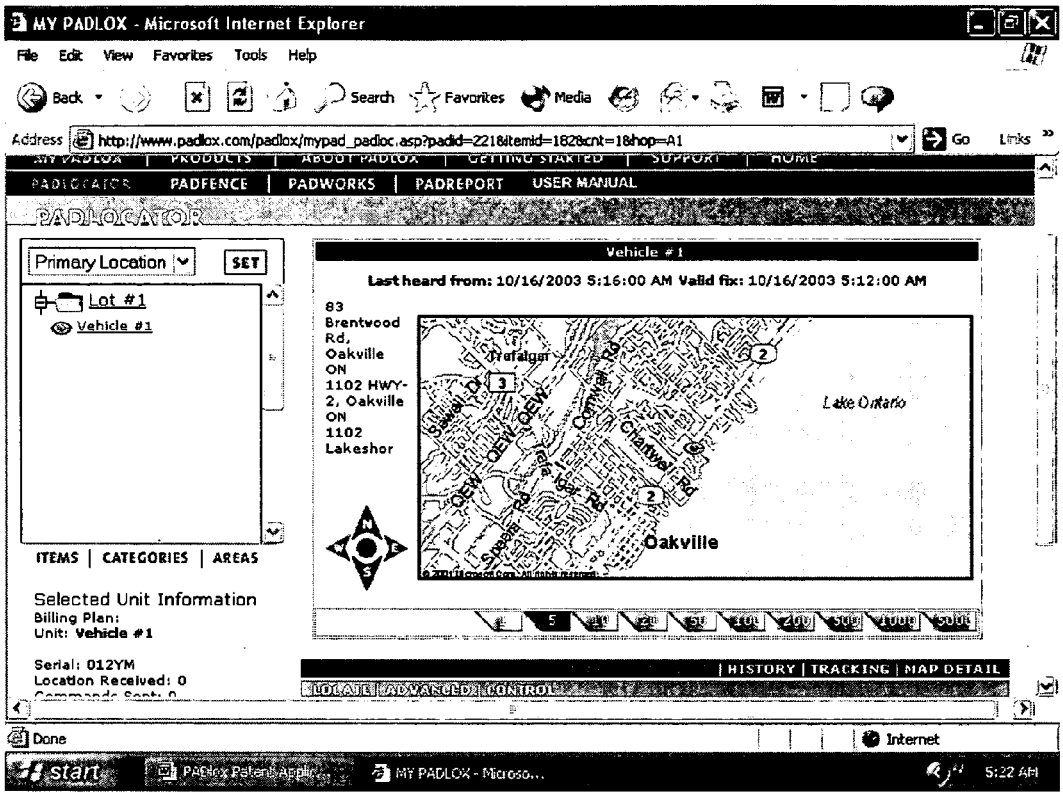
FIG. 2 illustrates a computer display of the current location of a protected item.

Referring to FIG. 2, the display shown is designed to show the current location of a protected item. The item is represented on a map by an icon selected from a list of available icons (in the example a red "eye" represents the item). The display provides the ability to zoom the map by selecting from the available elevations (1, 5, 10, 20, 50, 100, 200, 500, 1000) shown beneath the map. At any point, clicking on the LOCATE bar will provide an updated (in term of time) view of the present location of the protected item.

Figure 3:
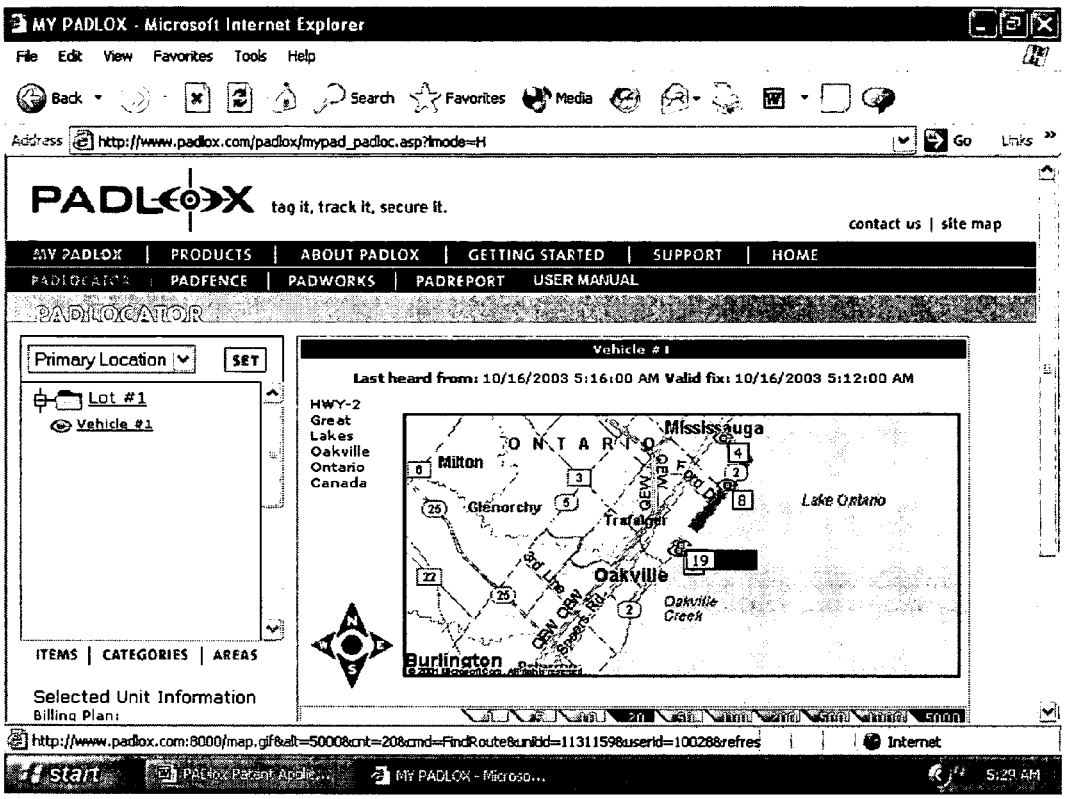
FIG. 3 illustrates a computer display of a history of where a protected item has been.

The answer to the question "Where has the protected item been"? is obtained by selecting the HISTORY bar that is shown beneath the map in FIG. 2. The resulting display is shown in FIG. 3.

A series of icons show the location of the protected item from a historical perspective. The icons are connected with a wide green line and are numbered in order to show the time sequence of the movement of the item.

Finally, selecting the TRACKING bar that appears under the map display displays an icon representing the item superimposed on a map. The position of the item will be shown by the icon moving in discrete two minute intervals on the map. This provides the answer to the question "Where is the protected item going"?

Special Tracking Features

In addition to the three different views of the data that is collectable by the system, a feature called a PADfence is provided. A PADfence is an algorithm that provides a processing rule for a specific situation. Currently three types of PADfences are available. See FIG. 4.

Motion PADfence: This PADfence allows the owner of an item to specify a speed, which if exceeded for a pre-specified time period results in a pre-defined action by the PADlox system. Pre-defined actions that are supported by PADlox are: (1) sending e-mail to one or more recipients; (2) sending a fax to one or more recipients; and (3) telephoning one or more recipients. PADlox places no limit on the number of recipients for each mode of communication. PADlox does not limit the mix of communications modes for an individual item.

The Motion PADfence has some special features, for particular types of items.

For all items that are mechanically mobile, such as automobiles, the breach of this PADfence can cause the vehicle lights to blink and the vehicle horn to sound. A breach of this PADfence can automatically inform law enforcement at both the location from which the item was removed, and the location at which the item is currently located. This concept is consistent with the idea of an item assisting in its own recovery.

The Motion PADfence operates entirely on the PADtag, and therefore no network transmission costs are incurred until the PADfence is breeched.

Perimeter PADfence: This PADfence allows the owner of an item to specify the diameter of a circle, centered at the present location of an item. If the item breeches the boundary of the defined circle, PADlox will initiate a predefined series of actions. . Pre-defined actions that are supported by PADlox are: (1) sending e-mail to one or more recipients; (2) sending a fax to one or more recipients; and (3) telephoning one or more recipients. PADlox places no limit on the number of recipients for each mode of communication. PADlox does not limit the mix of communications modes for an individual item.

The breach of a Perimeter PADfence can be from either of two directions: (1) from the center of geometric shape, outward toward the defined perimeter; or (2) from outside the defined perimeter inward toward the defined perimeter.

The Perimeter PADfence has some special features, for particular types of items. For all items that are mechanically mobile, such as automobiles, the breech of this PADfence can cause the vehicle lights to blink and the vehicle horn to sound. A breech of this PADfence can automatically inform law enforcement at both the location from which the item was removed, and the location at which the item is currently located. This concept is consistent with the idea of an item assisting in its own recovery.

The Perimeter PADfence operates entirely on the PADtag and therefore no network transmission costs are incurred until the PADfence is breeched. This feature helps to minimize the cost of operating a PADtag on any communication network. The communication network is employed only when information is to be provided to the owner of a protected item. In this context "information" is defined to mean a change in the location or condition of the protected item.

Geography PADfence: This PADfence allows the owner of an item to specify a defined, irregularly shaped area, such as a county or state. If the item breeches the boundary of the defined geography, PADlox will initiate a predefined series of actions. Pre-defined actions that are supported by PADlox are: (1) sending e-mail to one or more recipients; (2) sending a fax to one or more recipients; and (3) telephoning one or more recipients. PADlox places no limit on the number of recipients for each mode of communication. PADlox does not limit the mix of communications modes for an individual item.

The Geography PADfence has some special features, for particular types of items. For all items that are mechanically mobile, such as automobiles, the breech of this PADfence can cause the vehicle lights to blink and the vehicle horn to sound. A breach of this PADfence can automatically inform law enforcement at both the location from which the item was removed, and the location at which the item is currently located. This concept is consistent with the idea of an item assisting in its own recovery.

The Geography PADfence operates entirely on the PADtag and therefore no network transmission costs are incurred until the PADfence is breeched. This feature helps to minimize the cost of operating a PADtag on any communication network. The communication network is employed only when information is to be provided to the owner of a protected item. In this context "information" is defined to mean a change in the location or condition of the protected item.

PADtrail: The software that is resident on the PADtag also can provide information about the location of an item even if a specific PADfence has not been activated. The software automatically obtains and stores the last 10 days of location information in 30 minute intervals. This means that if an item is missing, and no PADfence had been set, the user can still obtain a display of the movement of the item during any part of the prior 10 day period. An important aspect of this feature is that no network transmission cost is incurred, except when the user requests to see the last 10 days (or lesser interval of the last 10 days).

Because of the PADfences and the PADtrail, (the availability of up to the last 10 days of location data), the effectiveness of PADlox, is increased with no incremental cost to the user. This is significant when one considers the cost involved in protecting an item.

PADlox and law enforcement: The ability to locate an item is only the first step in having a missing item returned to its rightful owner. A total solution requires the effort of law enforcement to recover the item. The PADlox system contains a database of municipal and state law enforcement agencies within the United States. PADlox provides the user with the ability to electronically inform the appropriate law enforcement agencies of the loss of any protected item. Specifically PADlox provides the following functionality:

When a user requests a map showing the current location of a missing item, a button, on the map is provided called "Report The Loss". Selecting this button will automatically cause the following to occur:

(a) If the user has identified their insurance agent, that agent will receive either an e-mail, fax or telephone call (depending on the information available), informing him/her of the loss.

(b) Law enforcement in the venue where the item normally is located will receive either an e-mail, fax or telephone call (depending on the information available) informing them of the loss.

(c) Law enforcement in the venue where the item is presently located will receive either an e-mail, fax, telephone call (depending on the information that is available) informing them of the loss. In addition this law enforcement agency will be provided with a URL so that it will be able to view the motion of the missing item in real time.

Special Item Specific Functionality

The transceiver employed within a PADtag can provide item specific protection for specific type of items. The transceiver has multiple input and output channels that can be used to control functionality within specific types of items. The following example is provided:

For an automobile, the transceiver outputs can be connected to various elements of the electrical system. These elements include:

a. The engine crank can be disabled when the vehicle is not moving.

b. The lights can be made to blink.

c. The horn can be made to sound

All of these elements can be controlled remotely from any Internet connection. Clearly, any motorized item can be controlled in a similar manner. Other items where specific functions are possible include motorcycles, trucks and boats.

Using the input/output channels that are provided, you can employ the use of devices such as shock sensors, digital thermometers, contact sensors to provide additional forms of protection for an asset.

The Hardware Component: PADtags

Figure 5:
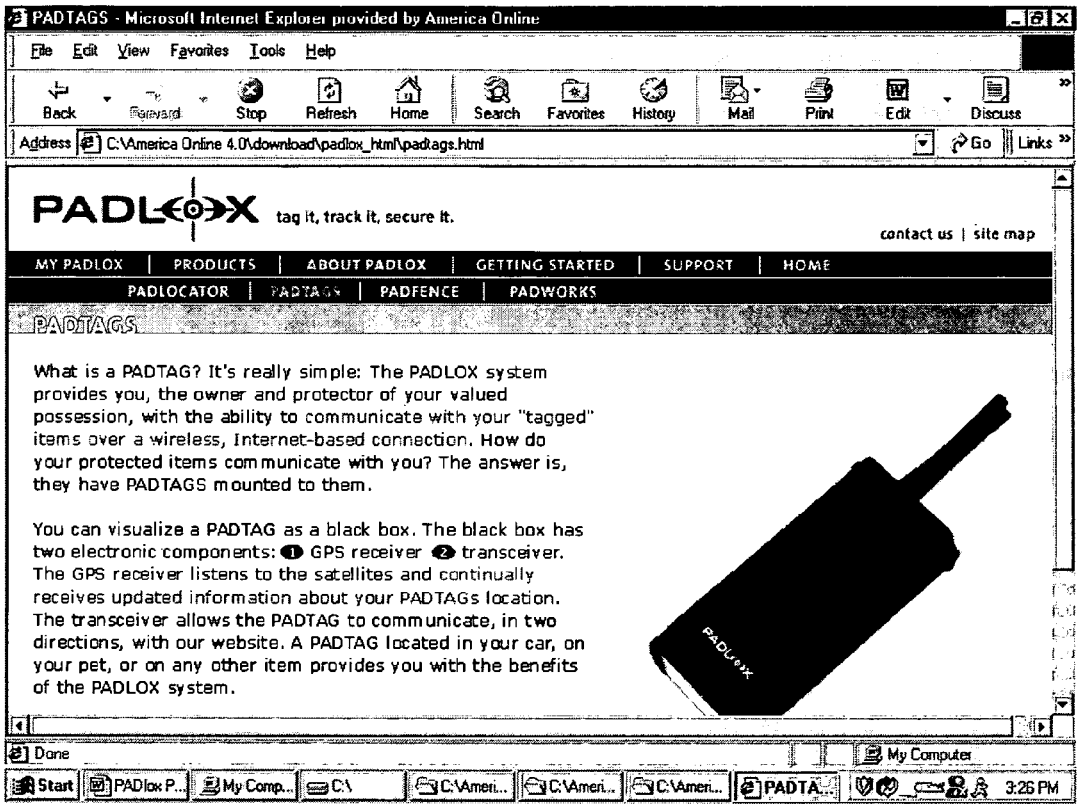
FIG. 5 illustrates a computer display screen for establishing a PADtag in accordance with the invention.

Deploying PADtags on individual items extends the usefulness of the PADworks database. A PADtag is a tracking device, that when used in conjunction with the PADworks application software allows a user to communicate over any Internet connection with a protected item. A protected item is defined as any item onto, or into which, a PADtag has been placed. The fundamental or basic PADtag is described below. Special purposes adaptations are anticipated to the basic PADtag for special purposes. The basic PADtag is shown in FIG. 5.

The PADtag provides the following functionality:

a. The ability to communicate over a commercial communications network with the PADworks application software.
b. The ability to receive location related information (latitude, longitude, date time, speed and direction of travel) from the Global Positioning System (GPS).
c. The ability to transfer data from the GPS to the communications network, and perform on board calculations and execute processes related to the management of a protected item.

The functional components of a PADtag:

The functionality provided by a PADtag dictates the components that the tag contains. Fundamentally, all PADtags contain the following components:

A wireless transceiver that provides the ability to communicate over a commercial communications network. There are several types of communications network available both within the United States and worldwide. Each different communications mode requires its own unique transceiver. The PADtag has been designed in a modular manner so as to be able to build a tag that can utilize the more common communications networks: reflex, GSM, cellular, satellite and micro burst. For a specific PADtag the type of transceiver that is on board determines the network over which the PADtag will operate.

A GPS receiver that provides the PADtag with the ability to receive location related information from the GPS. GPS receivers are manufactured by companies such as Garmin, Trimble and Motorola. All of the GPS receivers provide the data string in a standard NEMA defined format. This means that potentially a PADtag can employ product offerings from each of these and other manufacturers. The ultimate choice is primarily dependent on the size, cost and functional specifications of the specific GPS receiver.

A microprocessor that provides the PADtag with the ability to transfer data string from the GPS receiver to the wireless transceiver. The microprocessor also gives the PADtag the ability to perform on board calculations and perform processes that protect an item. Resident on the microprocessor is firmware (software) that provides the instructions that are necessary for the PADtag to function. The basic firmware for the PADTAG is based around the Rabbit 3000 series processor, manufactured by Rabbit Semiconductor (www.rabbitsemiconductor.com).

This specific chip provides a number of useful features, such as 6 independent serial IO ports, and over 50 ports configurable as binary input, output, interrupts and pulse samplers and generators. In addition the Rabbit 3000 operates over a wide range of clock speeds, allowing lower power consumption while still providing intelligent responses to various inputs and interrupts.

The PADtag also provides a motion detector that allows the device to operate at very low voltage and clock speeds and still detect the introduction of motion to a protected item. This feature is of extreme value in minimizing the cost of providing specifics types of protection for an item.

The final component of every PADtag is the PAD firmware. This component, which is described below in greater detail, provides the ability to process various commands and execute processes that are necessary to manage and protect an asset. It is the firmware that enables the web based application (PADworks) to interact with the hardware contained with the PADtag.

Figure 6:
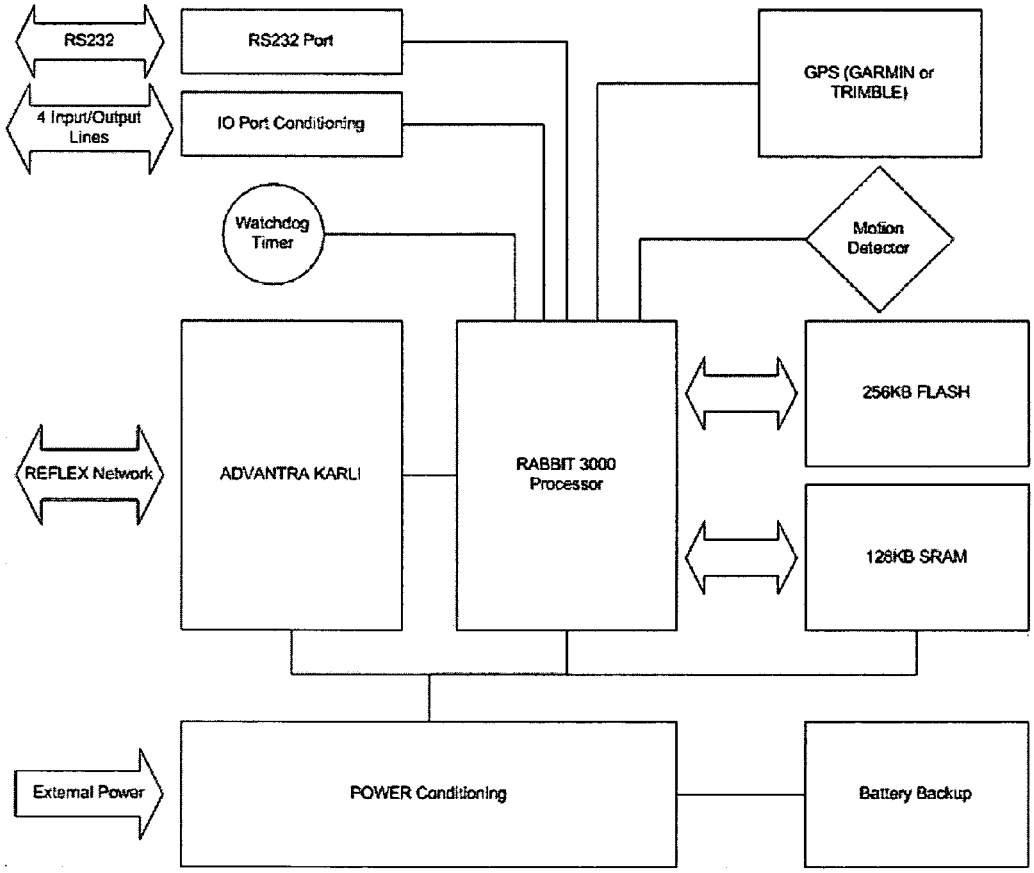
FIG. 6 illustrates a block diagram of a PADtag showing the physical integration of a transceiver, a GPS receiver and a microprocessor in accordance with the invention.

Referring to FIG. 6, wherein the physical integration of the transceiver, the GPS receiver and the microprocessor is shown, Advantra Karli is a wireless transceiver; the Rabbit 3000 is the on board microprocessor; and the Garmin or Trimble GPS is a commercially available GPS receiver.

The PADtag has the ability to shut off, programmatically, the GPS, Karli, and RS232 port power to conserve energy. The PADtag can provide power-conditioning circuitry for special deployment such as motor vehicles that have noisy electrical systems.

Hardware Features:

In addition to the GPS and wireless transceiver, the basic PADtag has a number of hardware features. These include:

Motion detector: Independent of the GPS, the PADtag can determine if it is in motion or not. This allows the placement of the tag, in a low power mode, on an item, and allows it to wake up and broadcast its location when in motion.

FLASH memory: 256K of FLASH memory contains the firmware. Also stored in the flash is a running log of where the item has traveled. At half hour intervals GPS data is stored in FLASH. The last ten days of an items history, in 30 minutes intervals are kept by default. This information can be extracted with an over the air command.

Power monitor: The PADtag can detect the presence of external power. When external power is not present, the PADtag can set itself into a low power mode, and continue transmitting, using its internal battery.

Battery: A battery is provided to allow the PADtag to continue operating for a period of time, allowing it to send its location in the event that external power is tampered with or removed. An event, such as an auto accident that destroys an auto's electrical systems and battery, will not stop the PADtag from sending the items location.

RS232 port: This port can be connected to an external computer, and can be used to set the internal configuration of the PADtag before it is deployed in the field. Information about the health of the tag and whether it remains in range of a REFLEX tower can be seen here. Versions of firmware will be available to use this port for operator input, or input from external devices, such as digital thermometers, or pressure and head monitors.

LED: An LED (light emitting diode) on the end cap of the tag relays information about the GPS, internal radio and other important information about the PADtag. A breakdown of this information will be provided later in this document.

Watchdog timer: Used if an unexpected condition causes the firmware to "lock". After seven seconds of inactivity, the unit will automatically reboot itself.

IO ports. The PADtag has four external IO ports. These can be programmed as either input or output ports. When set as inputs, these ports can be programmed to wake the unit out of low power mode, send a message or location data, or even set another IO port, set for output, high or low. A special feature of the PADtag allows ports set for output to be pulsed. When wired to a car horn, for example, the horn can be pulsed with a preset pattern.

Firmware Features:

The architecture of the PADtag allows for the following feature set to be included in a standard build of the firmware:

Alerts: Alerts are software structures that monitor various events that occur inside the PADtag. Depending on how these alerts are configured, various events can be acted on. The following are the standard alerts that are provided:

ALERT_PERIMETER_ENTER: This alert is set when an item enters a preset perimeter.

ALERT_PERIMETER_EXIT: Set when an item exits a perimeter.

ALERT_SPEED: Set when a preset speed is exceeded.

ALERT_ODOMETER: Set when the odometer exceeds a preset value.

ALERT_TRIPMETER: Set when the trip meter exceeds a preset value.

ALERT_POWERFAIL: Set when external power is removed or restored.

ALERT_IN_MOTION: Set when the motion detector finds the PADTAG is in motion, or stops moving.

ALERT_BATTERY_OK: Set when the internal battery is charged enough for all aspects of the PADTAG to function, or when it falls below a specific point.

ALERT_OUT_OF_RANGE: Set when a REFLEX radio tower is out of range of the PADTAG, and when returning back into range.

ALERT_INPUT: Used when one of the four input lines goes high or low.

ALERT_INPUT_ELAPSED: Used when one of the four input lines goes high or low for a preset number of seconds.

The output of an alert always sets a timer. Each alert has one timer dedicated to it.

Timers: Timers form the basic functional units of the PADtag. There is a timer associated with each alert structure. Timers are programmed in advance over the air, and can be enabled by alerts and events. Timers can be set to the following modes:

ONE TIME: The timer will be set off as soon as an event occurs.

DELTA TIME: The timer will go off at preset intervals, for a preset number of times.

ABSOLUTE TIME: The timer can be made go off at specific times. The timer can be made go off on a specific date and time (Universal Coordinated Time, as set by the GPS or transceiver) or repeatedly at the same time or day, (i.e. such as every day at midnight) with the use of wildcards.

There is one timer associated with each alert, and a number of "ad-hoc" timers available.

Events: Timers cause events to occur that change the internal status of the PADtag, and cause it to perform one or more of the following functions:

Transmit the current location.

Transmit a preset "canned" message.

Place the unit into a low power state.

Toggle an IO port (when configured as an output).

Issue an ad-hoc command.

Each timer holds a command buffer that can be preloaded with commands. On triggering the timer, these commands can be executed. These commands can set more alerts, other timers, and clear and set events.

The ability to recursively program the PADtag makes it a very powerful and flexible tool, eliminating the need for a great deal of over the air programming and the reissue of commands from the server.

The above structures are designed to respond to external events, and provide a means of providing important location information and provide other forms of output. Other structures are used to monitor and report on less "real time" data. These structures are:

PADtrail: The PADtrail is recorded (by default) once every half hour. Recorded data includes the current location and date and time, as well as item speed and direction, and a flag showing if the unit was out of range at the time of the reading.

By default, 480 entries are stored in the devices FLASH memory each day. 10 days of data are stored in a circular buffer (10×48=480 entries), with the oldest entries overwritten when the buffer is filled.

Transmit Queue: This structure holds messages prepared for transmission. When the unit is out of range of a REFLEX tower, messages produced by the PADtag are held in a circular buffer. When the buffer completely fills, the oldest message is overwritten with newer data. By default, this value is set to sixteen messages.

Receive Queue: This structure holds received messages from the REFLEX network. Like the transmit queue, the receive queue holds messages until the PADtag can process them. This is useful when the PADtag returns to a coverage area, and has to deal with a large number of held messages. The receive queue is a circular queue, where the oldest data is overwritten when it overflows. The default number of queue slots is sixteen.

Odometer and Trip meter: These structures record the number of miles or kilometers an item travels. This value is set continuously from the GPS when it presents valid data. The odometer and trip meter are updated every 5 seconds. If view of sky is lost (such as a vehicle traveling through a tunnel or parked in an underground garage), the distance is recalculated once the GPS returns to a valid state. The initial odometer reading is record at the outset of use of the PADtag. The trip meter can be reset at any point in time so as to be able to record the length of a specific trip.

PADtag Internals

PADtag Functional Overview

Firmware Overview

Figure 7:
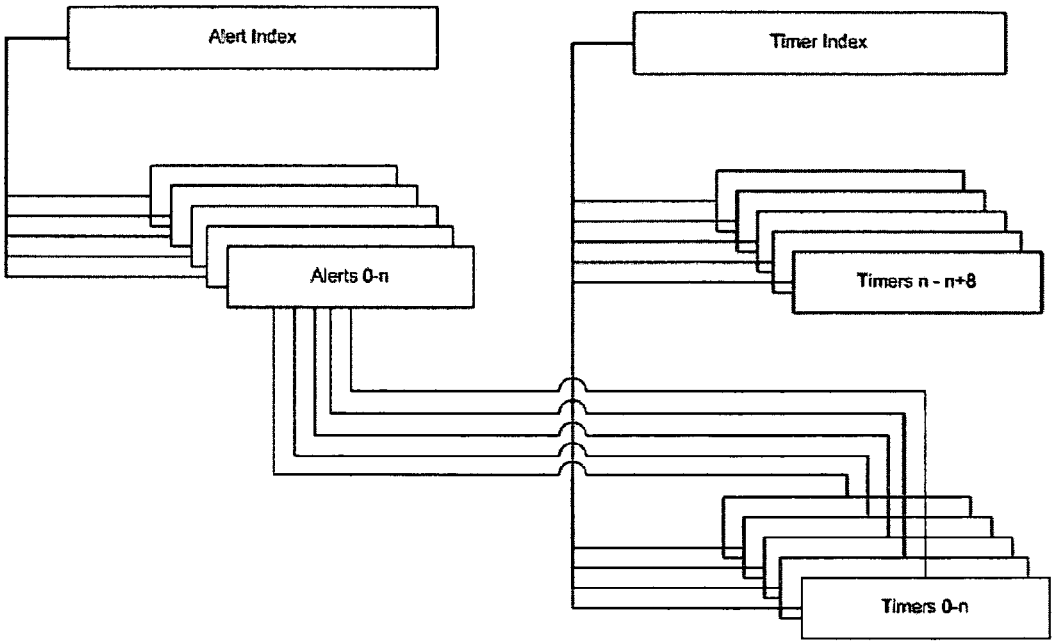
FIG. 7 illustrates a scematic of the relationship of the alert objects and the timers employed in the system of the invention.

Referring to FIG. 7, the relationship of the alert objects and the timers are as illustrated. There are (in a standard build of the firmware) eight "stand-alone" timers that can be used independently of the alerts. There are twenty four alert objects (in a standard build of the firmware). These have pointers to the next twenty four timer objects. So, alert object 0 references timer object 0, alert 9 to timer 9 and so forth.

PADtag Alerts

The reason for all the alert structures is that this allows the PADtag itself to hold many alarm and timer settings at the same time, without a lot of over the air programming. For example, by setting a number of ALERT_PERIMETER_ENTER alerts to different points on a route, and a perimeter of 0.5 miles (or km), the PADtag can notify a dispatcher when a truck arrives at a destination. By using these alerts as waypoints, a daily record of a vehicles progress can be maintained in a database. On a smaller scale, a perimeter set around your home can let you know when a teenage driver has arrived back safely.

An ALERT_PERIMETER_EXIT can be used to set a perimeter around an object. If the object leaves the perimeter, the alert fires and the associated timer is enabled. By default, the timer will send 10 pages at 5 minute intervals (but this is programmable).

Alerts can be programmed for excessive speed, the odometer exceeding a given setting (good for automating service reminders to customers), the trip meter exceeding a preset value, motion (as detected by the motion detector, useful for a vehicle that is in a parking garage without a clear view of sky), battery low alert, out of range alert (since the device can not transmit, it might be used to light a lamp an operator can see) and one of the input lines being driven high or low (a "panic" button, or airbag deployment notification, as examples).

Over 24 such entries can be maintained concurrently on the PADtag.

PADTAG Alert Processing

PADTAG Alert Basics

Alerts are set by using the over the air command set. All alert commands ar in the following format:

*A?nn . . .

Where:

*=this is an over the air command

A A=Alert command

?=specific alert command nn=the alarm "slot" that you are using (0–23)

A "miscellaneous" command, useful for setting many types of alerts, is:

*AMnnmets

Where:

*=this is an over the air command

A=Alert command

M=miscellaneous commands nn=the alarm "slot" that you are using (0–23)

m=mode e=enable=1, disable=0 t=toggle the alert, 1=on. 0=off s=state, FALSE if 0, TRUE if 1 d=optional. If=1, then set item parameters to default settings

Many of the alerts can be set using the *AM command, and all can be modified or disabled with it. In the following example, we will set a specific alert slot with an alert:

*AM018101

This command will enable its timer when the onboard motion detector is active (i.e. the PADtag is bumped or moved). Timers, by default will broadcast the location each time the device is moved.

In this example, we have set alert slot 01 with the alert type ALERT_MOTION. The table below shows the other alert codes. Note that these use hexadecimal notation:

TABLE 1

| Alert Name | # |
|---|---|
| ALERT__DISABLED | 0 |
| ALERT__PERIMETER__ENTER | 1 |
| ALERT__PERIMETER__EXIT | 2 |
| ALERT__SPEED | 3 |
| ALERT__ODOMETER | 4 |
| ALERT__TRIPMETER | 5 |
| ALERT__POWERFAIL | 6 |
| ALERT__IN__MOTION | 7 |
| ALERT__BATTERY__OK | 8 |
| ALERT__OUT__OF__RANGE | 9 |
| ALERT__INPUT | A |
| ALERT__INPUT__ELAPSED | B |

In the example, the mode is set to 8, which is the ALERT_MOTION code. The Alert is enabled, so the next time the PADtag is moved, the timer will activate, and an alert will be sent. This alert will only be sent once. Once dispatched, the enabled flag will be reset by the PADtag.

If the command set was *AM01801i, then a completely different behavior will be exhibited. In this example, the enable bit is cleared, preventing an alert from taking place. But the toggle bit is set to one. When toggle is set on an alarm or timer, then the next time the alarm condition becomes "not true", then the alert is enabled.

If one knew the item with the tag was currently in motion, then enabling it immediately would produce an immediate alert, which would provide you with no useful information. By disabling the alert, and enabling the toggle feature, the alert will only be set once the item comes to a halt. If the item then moves, the alert would be sounded. When the item stops, the toggle will reset it once again. This will continue until a command is sent disabling the alert or the toggle feature.

PADTAG Alert GeoFence Settings

Where this feature is the most powerful is with the next example. This command sets a specific aspect of the PADTAG, the GeoFence command.

*AFnnmetpppppdllll.llll,d,LLLL.LLLL,D

Where:

*=this is an over the air command

A=Alert command

F=is the perimeter "fence" command nn=the alarm "slot" that you are using (0–23)

m=mode e=enable=1, disable=0 t=toggle the alert, 1=on. 0=off ppppp is the perimeter radius, expressed in decimal miles (or km)

d=use default timer setting when a "d" is here. "0" for no default timer setting.

If "L", use local GPS information, or else llll.llll,d,LLLL.LLLL,D=optional latitude information (format the same as GPRMC, include commas and decimal points) where:

llll.llll=Latitude in degrees, minutes d=direction (N or S)

LLLL.LLLL=Longitude in degrees, minutes

D=direction (E or W)

Figure 8:
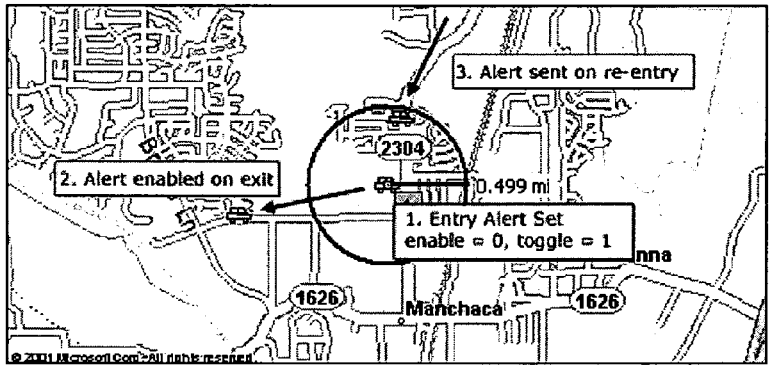
FIG. 8 illustrates a computer display screen for a given scenario for establishing an alert perimeter in accordance with the invention.

The following command will set the scenario depicted in FIG. 8.

*AF0211010.50L

The *AF command does not require the longitude or latitude of the item to be sent to it. If left off, it takes its current position from the GPS and loads that into the alert object (in this case, slot 02).The "mode" is set to ALERT_PERIMETER_ENTER=1. The "enable" bit is set to 0, and toggle set to 1. A perimeter radius of 0.5 miles is sent. (The coordinates of the alert are immediately sent back to the server system).

The alert remains off until the item moves beyond the 0.5 mile boundary. Once this happens, the PADtag will immediately enable itself. The alert will then only be transmitted once the item re-enters the alert perimeter.

The alert remains active, so it can be maintained continuously so that when a truck returns to a garage in the evening, this information is noted and recorded.

PADTAG Odometer Alerts

To set other alerts, the following commands are included. First, the odometer and tripmeter command:

*AOnnmetoooooo

Where:
*=this is an over the air command
A=Alert command
O=Odometer command
nn=the alarm "slot" that you are using (0–23)
m=mode
e=enable=1, disable=0
t=toggle the alert, 1=on. 0=off
oooooooo=the odometer or tripmeter setting to trigger when exceeded.

*AO104100020000 set alert slot 10 to mode 4, which is the odometer alert. It is activated (1) without toggling (0). When the internal odometer exceeds 20000 miles (or km), the alert is set.

To set the current odometer setting on your PADTAG:
*ODoooooooo

Where:
*=this is an over the air command
O=Odometer command
D=standard odometer
oooooo=mileage (or km) to set unit to. If left blank, the current reading is returned to the server.

A command of *OD- will clear the odometer to zero. Entering *OD with no arguments returns the current reading.

*AO10510001000 set alert slot 10 to mode 5, which is the tripmeter alert. It is activated (1) without toggling (0). When the internal tripmeter exceeds 1000 miles (km), the alert is set. The "sister" command to this is:
*OTc Where:
*=this is an over the air command
O=Odometer command
D=tripmeter
c=if 0 or -, clears the tripmeter, if empty, returns the current reading This also resets with the command *OT-. Simply entering *OT with no argument returns the current reading.

PADTAG Speed Alerts

Speed of the vehicle is another alert parameter:
*ASnnmetsss

Where:
*=this is an over the air command
A=Alert command
S=Speed command
nn=the alarm "slot" that you are using (0–23)
m=mode
e=enable=1, disable=0
t=toggle the alert, 1=on. 0=off
ssssss=Maximum speed. Exceeding this speed will trip alert

*AS09311060 will send an alert each time the vehicles speed exceeds 60 miles per hour.

PADTAG I/O Port Alerts

Finally, an alert is set fired by one of the four IO ports:
*AInnmetlSnnnnnnnn

Where:
*=this is an over the air command
A=Alert command
I=I/O commands
nn=the alarm "slot" that you are using (0–23)
m=mode
e=enable=1, disable=0
t=toggle the alert, 1=on. 0=off
I=the IO port to monitor
S=the state to set alert 1=high, 0=low
nnnnnnnn=optional number of seconds the IO is high or low

*AI07a1101 sets alert slot 7 for an ALERT_INPUT (a). The alert is enabled, and will toggle. Port 0 is monitored, and an alert is sent when the input is high.

Another feature of the IO ports is a counter marking the number of seconds the line is either high or low is maintained in the software. This number can also be used to fire an alert. *AI07b100128800 will fire an alert when the input has been high for 8 hours (28800 seconds). This is useful in monitoring the engine "on" time of remote machinery.

The specific port being monitored will need to be set to an input, and enabled before this alert will work. There will be more detail on the IO ports later.

PADTAG Timer Processing

PADTAG Timers Basics

Alerts are capable of doing only one thing: an alert enables a timer.

It is the timer that actually is responsible for sending messages, location data, and causing the IO port outputs to change state, or issuing "ad-hoc" commands. How does the timer manage this?

A timer can be in one of the following states:

TABLE 2

| Time Function | # |
|---|---|
| DISABLE_TIME | 0 |
| DELTA_TIME | 1 |
| ABSOLUTE_TIME | 2 |
| ONE_TIME | 3 |

All timer commands begin with a "T". To set the basic timer, use the following command:
*TMnnme Where:
*=this is an over the air command
T=Timer command
M=miscellaneous commands
nn=the timer "slot" that you are using (0-31)
m=mode
e=enable=1, disable=0
d=default. If=1, set timer to defaults The following command:

*TM0011 sets the timer function to DELTA_TIME and enables it. If the default settings are not changed, 10 location transmissions are sent at intervals of every 5 minutes.

*TM0131 sets the timer to ONE_TIME. This will immediately fire the timer once and reset it. This is usually used in conjunction with alerts.

PADtag Delta or Interval Timers

To actually change the values the timer will actually use, issue the following command:
*TDnneiiiiicccc Where:
*=this is an over the air command
T=Timer command
D=repeat at fixed intervals (delta time) command
nn=the timer "slot" that you are using (0–31)
e=enable=1, disable=0
d=delay first response, 1=delay, 0=respond and then count iiiii=interval in seconds between transmissions
cccc=total number of transmissions before stopping, all zeros=continuous

*TD0110006000010 will send a location transmission every 600 seconds (10 minutes) and will do so 10 times. Delay=0, so the first event will not be sent until after the first 10 minutes elapse.

PADtag Absolute or Scheduled Timers

Sometimes it is desired to have an event take place at a specific time every day, like at noon or midnight. The following command takes care of that:
*TAnnethhmmwwMMDDYYcccc Where:
*=this is an over the air command
T=Timer command
A=Absolute time
nn=the timer "slot" that you are using (0–31)
e=enable=1, disable=0
t=toggle=1, no toggle=0
hh=two digit hour, or ??
mm=two digit minute, or ??
ww=two digit day of week, or ?? (Sunday=00, Saturday=06)
MM=two digit month, or ??
DD=two digit day, or ??
YY=two digit year, or ??
cccc=optional maximum number of transmissions, all zeros=continuous

*TA021102359??????????0010 will fire the timer every day at midnight (23:59 hours) and will do so 10 times. The question marks are wildcard characters that mean "any value".

*TA0211020001??????01000 will fire the timer at noon, every Monday.

*TA03111????????01?? will fire the timer off the first day of every month, at midnight, continuously.

An absolute timer event will fire once, and then reset when the masked time becomes "not true". The "toggle" switch will set it for the next instance, if desired.

It should be remembered that the PADTAG internally is set to Greenwich Mean Time, or Universal Coordinated Time (UTC). You will need to add or subtract the appropriate number of hours to use your local time.

This covers the PADTAG timer basics. Alerts enable timers, and when a timer fires, it enables one or more events. What are those events, and how are they set?

PADtag Event Processing

PADTAG Event Basics

Timers carry two other structures inside them. The following commands set those structures:
*TLnnC3210SMLD Where:
*=this is an over the air command
T=Timer command
L=Load command
nn=the timer "slot" that you are using (0–31)
C=process command buffer, 1=yes, 0=no
0=IO port 3 (previously set as output) H=set output high, L=set output low.
1=IO port 2 (previously set as output) H=set output high, L=set output low.
2=IO port 1 (previously set as output) H=set output high, L=set output low.
3=IO port 0 (previously set as output) H=set output high, L=set output low.
S=sleep mode (uses default sleep mode) 1=yes, 0=no
M=send canned message (from message buffer)
L=send location message
D=disable all events, 1=yes, 0=no This loads an internal "action" buffer. Events are processed starting with the far right side of this buffer, and moving left.

The default "action" buffer is set to 000000010. The "1" is in the "send location" slot. *TL100H0000000 transmits nothing, but will drive IO port 3 high (the port must be set in advance as an output, by default it is). Other combinations are:

*TL10000000110 loads slot 10. This will send a location, and then immediately send a canned message. Another (easier) way to do this is with the next command:
*TKnnpc
*=this is an over the air command
T=Timer command
K=Load command (single position command)
nn=the timer "slot" that you are using (0–31)
p=position to overwrite
c=character to put in that position The "p" is a hex value representing the offset into the action string. The following table contains these offsets:

| Actions | # |
|---|---|
| Execute command buffer | 0 |
| IO Port 0 (set as output) | 1 |
| IO Port 1 (set as output) | 2 |
| IO Port 2 (set as output) | 3 |
| IO Port 3 (set as output) | 4 |
| Sleep Mode (uses default mode) | 5 |
| Message | 6 |
| Location (send) | 7 |
| Disable all actions (overrides all actions) | 8 |

*TK1061 puts the character "1" in position 6. This will now send both the location, and a message.

Of course, to send a message to need to load it first. To load a canned message:
*TGnnMMMMMM . . .

Where:
*=this is an over the air command
T=Timer command
G=Greeting
nn=the timer "slot" that you are using (0–31)
MMMMMM . . . a free text message, up to 40 characters. A free text message should never contain any * asterisks unless "escaped" with a "~" character. The ~ will be removed from the message if it is in front of a * before the message is sent.

*TL10000001000 will put the unit into a sleep state.

*TL10100000000 will execute the commands in the timers command buffer. These commands are the same as the over the air commands. This gives us the ability to set and clear other alerts and timers. This command buffer is set by the following command:
*TCnn*cmd1~*cmd2~*cmd3 . . .

Where:
*=this is an over the air command
T=Timer command

C=Command buffer
nn=the timer "slot" that you are using (0–31)
*cmd1=OTA command 1
*cmd2=OTA command 2
*cmd3=OTA command 3

The command buffer will accept up to 80 characters. As many commands as will fit can go into it. Each command is preceded by a "~" (forward slash) and an asterisk.

Practical Examples

This provides a very powerful tool in setting and resetting alerts. Let's set two timers with two command strings:
*TC01~*AF00111.00000L
*TL0110000000
*TC02~*AM0000
*TL0210000000
*TA0111800??????????9999
*TA0210600??????????9999

These commands can be sent serially, or grouped into two transmissions . . .

*TC01*AF00111.0000*TL0110000000*TA0111800??????????9999 and

*TC02*AM0000*TL0210000000*TA0210600??????????9999

Due to differences in different carriers network, each outbound transmission should be kept to 80 characters or less, to assure proper reception.

The "free standing" timers are set to turn on a fence every day at 6:00 PM, UTC (18:00 hours) and shut off the fence at 6:00 AM UTC (06:00 hours). This will set a boundary around a vehicle used by a business in the evening after the vehicle is parked, and clear the boundary in the morning before an employee arrives to use the vehicle again. .

PADLOX Additional Features

PADtrail

Automatically captured whenever the PADtag is operating under normal conditions is the "PADtrail". The PADtrail stores positional information every half hour while the GPS is registering valid positional information. This information is stored in the devices' FLASH memory.

If a vehicle is found to be missing and subsequently located, or the owner suspects that their car or truck may made been driven to unauthorized locations, a "history" of the vehicles travel can be recalled from the PADtag memory. Up to ten days history can be extracted from the PADtag.

Each day holds 48 PADtrail entries. To extract a number of entries, starting from the newest entry, enter this command:
*SNnnnn Where:
*=this is an over the air command
S=Snail trail command
N=Numeric offset
nnnn=The number of entries to extract.

The data in the PADtrail file will be sent, with the oldest information sent first. *SN048 will retrieve one full days worth of recorded location information. *SN096 will send two days worth, etc.
*SRoooooonnnn Where:
*=this is an over the air command
S=Snail trail command
R=Relative offset
ooooo=Offset into the snail trail file
nnnn=number of entries to extract.

This command will offset from the newest entries, and extract starting from that point towards the newest entries. *SR002400048 will go back 5 days and extract one days worth of location information. *SR004800005 will extract 5 records from 10 days prior.

As many "PADtrail" records are placed in a single transmission as possible. A "–" character separates each record.

PADtag I/O

The PADtag provides 4 external IO ports. These ports can be configured as either inputs or outputs. By default, Port 0 is configured as an input. Port 1, 2 and 3 are configured as outputs. These are also active by default.

The basic IO command is as follows:
*IOnnms

Where:
*=this is an over the air command
I=Input/Output command
O=Basic set command
m=mode 0=input, 1=output, 2=disable
s=output state 0=low, 1=high Setting *IO0111 will set Port 1 to output, and make it go high. *IO010 set the port to an input.

Sending just *IO will return the following string

|IO|oooo|iiii

The first four oooo are ports 0–3 outputs, respectively. When set to 1, the output is floated high (output is open collector). When 0, the output is sent to ground.

Port inputs are represented by iiii, which are ports 0–3 respectively. To accept input, the corresponding output is set to 1, to cause the output to float. This is detected on the input lines. These inputs values are inverted, so 1111 means all 4 lines are low.

What do you do with the input lines, you might ask? The following commands are a practical demonstration:
*AI20a1111*TL200000H0010*IO010*IO0310

The first command sets an alert to monitor a specific input (1). The *TL command programs an event to drive port 3 high when active, and to send a location message.

The last two commands configure port 1 as an input, and port 3 as an output, with its line set low.

Input line 1 can be attached to an ignition switch or "panic" button. When driven high, it sets off the alert, which will send the current location to the remote server, and then drive port 3 high. This can be connected to a relay circuit, and drive a noisemaker of some kind. This provides basic "panic button" functionality.

Sometimes, one wants to "pulse" an external device, like a horn, or headlights. Usually, external circuitry is required for this. But with the PADtag, you can enter this command:
*IPnnsxxxxxxxxxxxxxxxxxxxxx Where:
*=this is an over the air command
I=Input/Output command
nn is the port to set.
P=Pulse command
s=state H=high, L=low
xxxxxxxxxxxx=pattern to enter (20 characters)

By default, all patterns for a high state are 11111111111111111111 and low are 00000000000000000000. This way, the line stays at steady state.

Entering *IP03H11110000011111100000 makes the output pulse at one second high, and one second low. (Each character represents 1/5 second).

*IP03L00000000000101010101 sends rapid pulses and a space when the line is low.

*IO032 will disable the port.

The final IO topic is elapsed time. When driven as an input, the amount of time the line remains high or low is kept in counters. To access these counters:
*IEnnsxxxxxxxx Where:
*=this is an over the air command
I=Input/Output command
nn is the port to set.
s=state H=high, L=low
xxxxxxxxxxxx=seconds to enter (all zero to clear)

*IE02H10000 will preset the counters to 10000 seconds. *IE02L0 will clear the low counter.

Just *IE returns

|IE|HHHHH|LLLLL where HHHHH is elapsed high seconds, and LLLLL is elapsed low.

Used in conjunction with *AI20b1121100000 will send a message when port 2 is high for 100000 seconds.

The PADlox system is an asset management and protection system which provides the ability to locate a protected item using an integrated suite of technologic advances. For the purposes of this discussion, a protected item is one onto which a specially designed electronic tag has been affixed.

Figure 9:
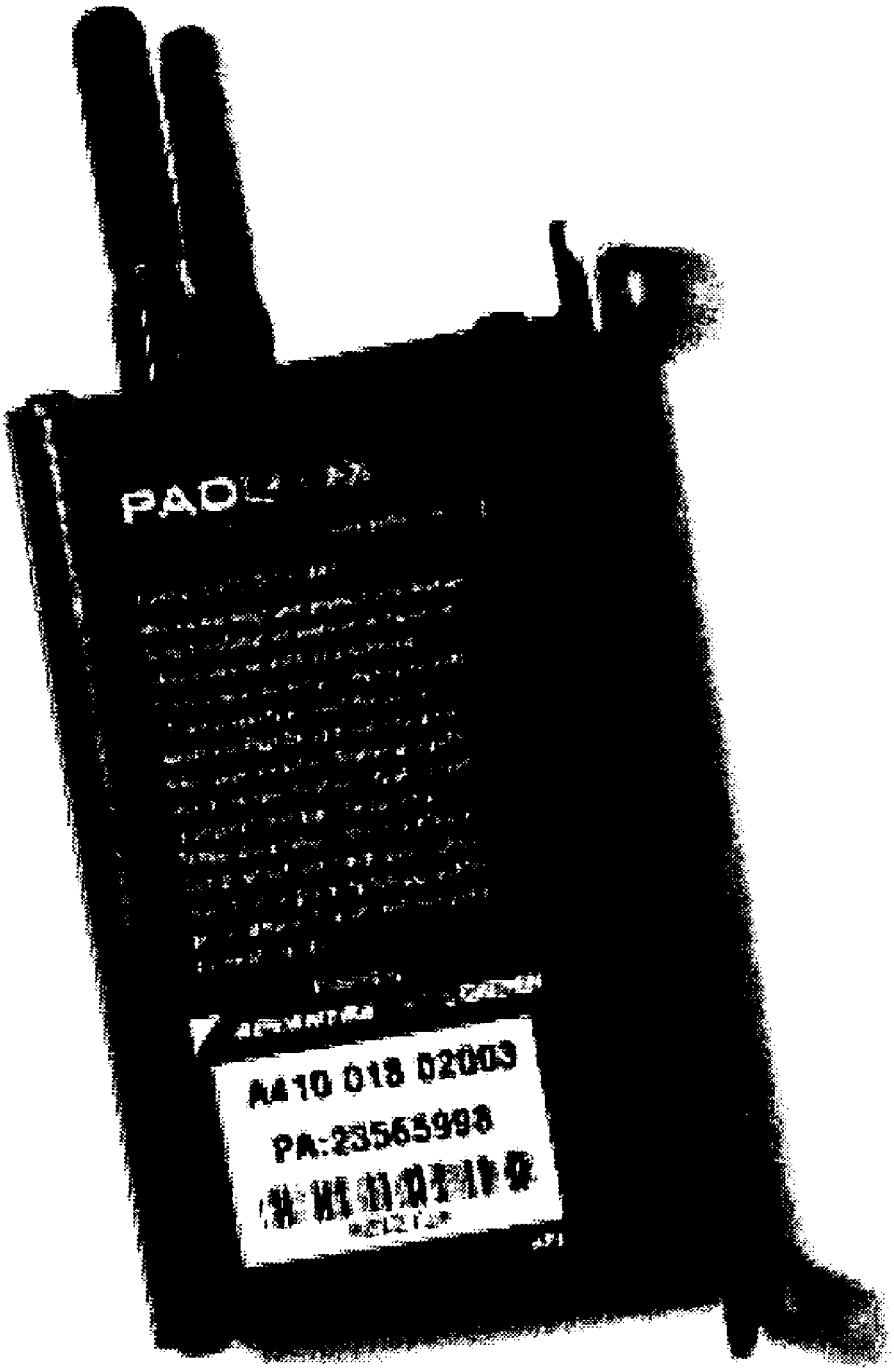
FIG. 9 illustrates an electronic tag according to the invention.

FIG. 9 illustrates an electronic tag that may be affixed, for example to a vehicle. To maximize the effectiveness of the PADlox system system, the electronic tag should be affixed so that the tag is not visible. The location of the tag on a specific item requires thought and planning so that the tag is mounted securely and hidden from sight.

In the PADlox system, an item onto or into which a PADtag has been affixed is called a protected item. A protected item is the only type of item that is addressed by PADlox.

The electronic PADtag provides the following:

a. the ability to communicate over a commercial communications network with the PADworks application software.
b. The ability to receive location related information (latitude, longitude, date time, speed and direction of travel) from the Global Positioning System (GPS).
c. The ability to transfer data from the GPS to the communications network, and to perform on board (within the PADtag) calculations and execute processes related to the management of a protected item.

The functional components of a PADtag:

The functionality provided by a PADtag is determined by the components that are provided within the tag. Fundamentally, all PADtags contain the following components:

1. A wireless transceiver and antenna: This component provides the tag with the ability to communicate over a commercial communications network. There are several types of communications network available both within the United States and worldwide. Each different communications mode requires its own unique transceiver. The PADtag has been designed in a modular manner so as to be able to build a tag that can utilize the more common communications networks: reflex, GSM, cellular, satellite and micro burst. For a specific PADtag the type of transceiver that is on board determines the network over which the PADtag will operate. The functionality of the transceiver remains independent of the communications network. The PADlox system requires bidirectional or two way communications, and therefore all PADtags are equipped with transceivers, not just a transmitter or a receiver.

2. A GPS receiver and antenna: This component provides the PADtag with the ability to receive location related information from the GPS. GPS receivers are manufactured by companies such as Garmin, Trimble and Motorola. All of the GPS receivers provide an output data string in a standard NEMA defined format. This means that potentially a PADtag can employ product offerings from each of these and other manufacturers. The ultimate choice is primarily dependent on the size, cost and functional specifications of the specific GPS receiver. The Global Position System (GPS) is maintained by the United States Department of Defense. The GPS consists of 24 orbiting satellites that continually send out ranging signals that a GPS receiver is capability of detecting and using to calculate the latitude and longitude of the specific GPS receiver—and therefore any protected item. The deployment of the GPS antenna requires a view of the sky in order to communicate with the GPS satellites.

3. A microprocessor: The component provides the PADtag with the ability to: (1) transfer data strings from the GPS receiver to the wireless transceiver; and (2) perform on board calculations and processes that protect an item. Resident on the microprocessor is firmware (software) that provides the instructions necessary for the PADtag to function. The basic firmware for the PADtag is based around the Rabbit 3000 series processor, manufactured by Rabbit Semiconductor.

This specific microprocessor provides a number of useful features, such as 6 independent serial Input/Output (IO) ports, and over 50 ports configurable as binary input, output, interrupts and pulse samplers and generators. In addition, the Rabbit 3000 operates over a wide range of clock speeds, allowing lower power consumption while still providing intelligent responses to various inputs and interrupts. By employing some of the available IO ports in conjunction with the firmware, the PADtag can support the use of a variety of external devices such as digital thermometers, contact sensors, pressure gauges, and relays that allow the PADtag to extend its capabilities beyond "location" reporting. For example, by employing a digital thermometer, the PADtag can be used to monitor the temperature in a trailer that is transporting fruits and vegetables.

When the PADtag IO ports are connected to a series of relays, the PADtag can be deployed in a motor vehicle to: (a) cause the lights to blink; (b) the horn to sound; and (c) disable the ignition when the vehicle is stopped. Additional vehicle functions can be controlled by adding additional relays.

4. A motion detector: This allows the device to operate at very low voltage and clock speeds and still detect the introduction of motion to a protected item. This feature is of extreme value in minimizing the cost of providing specifics types of protection for an item. For example if the trailer of a tractor/trailer combination is removed and left at a location (called the "delivered location"), the efficiency of monitoring of the trailer is greatly enhanced specifically because of the presence of the motion detector. The monitoring of the trailer in such an instance is concerned only with the presence of the trailer at the "delivered location". Typically, a device will periodically request the location of the trailer and compare that to the "delivered location". A difference in the location will result in the device initiating some action. This approach requires air time on the wireless communications network, and is potentially expensive. The PADtag with its motion detector eliminates the need for periodic location requests, and the use of air time is minimized. The motion detector, acting as a switch can initiate a predefined action (telephone alert, email, page or fax) without the need for periodic location requests. This capability, which is possible because of both the hardware and firmware associated with the PADtag, increases the effectiveness of the PADlox system, with increasing the operating costs.

5. FLASH memory: 256K of FLASH memory contains the firmware. Also stored in the flash is a running log of where the item has traveled. At half hour intervals GPS data is stored in FLASH. The last ten days of an item's history, in 30 minutes intervals are kept by default. This information can be extracted with an over the air command.

6. Battery: A battery is provided to allow the PADtag to continue operating for a period of time, allowing it to send its location in the event that external power is tampered with or removed. An event, such as an auto accident that destroys an auto's electrical systems and battery, will not stop the PADtag from sending the item's location.

7. Power monitor: The PADtag can detect the presence of external power. When external power is not present, the PADtag can set itself into a low power mode, and continue transmitting, using its internal battery.

8. RS232 port: This port can be connected to an external computer, and can be used to set the internal configuration of the PADtag before it is deployed in the field. Information about the health of the tag and whether it remains in range of a REFLEX tower can be seen here. Versions of firmware will be available to use this port for operator input, or input from external devices, such as digital thermometers, or pressure and head monitors.

9. LED: An LED (light emitting diode) on the end cap of the tag relays information about the GPS, internal radio and other important information about the PADtag. The following are the LED displays and their meaning:

| LED | Meaning |
|---|---|
| "11111000001111100000" | A one second on, one second off cycle indicates the unit is in a normal, idle operational state. |
| "11100000001110000000" | A ⅗ second pulse every 2 seconds shows the unit is in a reduced power state. The RS232 port is powered down, and the GPS is powered on only when needed. |
| "10000000000000000000." | A ⅗ second pulse every 10 seconds shows the unit is in a "sleep" state. It can be woken with a pre-programmed input, power restoration, reception of a message, or periodically via a timer. |
| "10000000000000000000." | A ⅕ second pulse every 4 seconds shows a failure of the GPS. The internal GPS cable is broken or missing, or the unit itself has failed. |
| "10100000000000000000" | Two ⅕ second flashes every 4 seconds shows the GPS is functional, but does not have a valid fix. This is normal for the first minute or two of operation. If the condition persists, check the GPS antenna cable, and the position of the GPS antenna for proper view of sky. |
| "10101000000000000000." | Three (3) ⅕ second flashes shows a general failure of the radio transceiver. If this does not clear, the internal batteries may need to be changed, or the PADtag needs to be serviced. |
| "10101010000000000000" | Four (4) ⅕ second flashes shows a transmission failure state. This can happen when the unit is moving between towers. If this condition persists, check the radio antenna and associated connector. Also check the internal battery. If these are OK, then the unit should be retuned for service. |

10. Watchdog timer: Used if an unexpected condition causes the firmware to"lock". After seven seconds of inactivity, the unit will automatically reboot itself.

11. The final component of every PADtag is the PAD firmware. This component, provides the ability to process various commands and execute processes that are necessary to manage and protect an asset. It is the firmware that enables the hardware contained with the PADtag to interact with the web based application (PADworks). The PADworks web based application is the mechanism through which the user can initiate a request to the PADtag.

Figure 10:
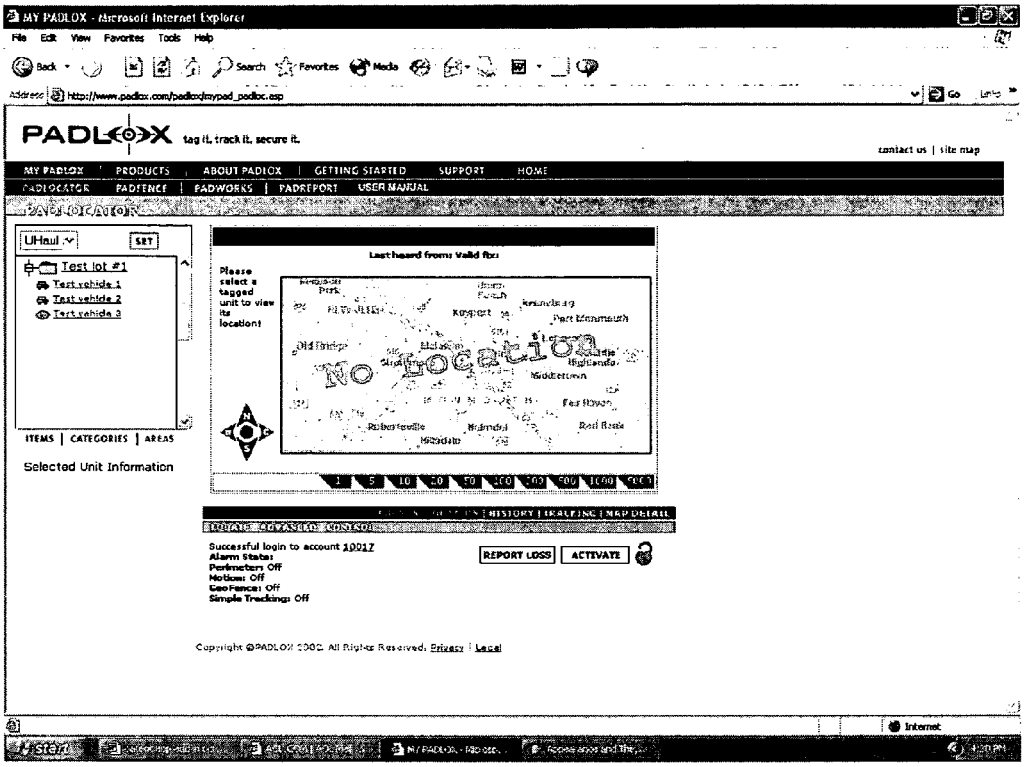
FIG. 10 illustrates a computer display screen displaying when a user first logs onto his/her account.

Initiating a Request For a Location:

As noted above, a PADtag is capable of communicating with both the GPS and a PADlox user through the web based application called PADworks. To initiate a request for the current location of a protected item, the user logs onto his/her account and is presented with a display as shown in FIG. 10.

A request for the current location of an item is initialed by first selecting the item from the list provided on the left side of the display. In the FIG. 10 illustration there are three items: Test Vehicle 1, Test Vehicle 2 and Test Vehicle 3. By double clicking on Test Vehicle 3, the user can then click on the LOCATE bar appearing under the map in order to initiate a request for the current location of the protected item.

These requests are transmitted from the web based PADworks application by the communications server to the wireless network on which the PADtag is active. The message that is transmitted in response to a LOCATE request is shown in Fig.

The PADtag receives the LOCATE request from the web application over the wireless network. The firmware on the Rabbit microprocessor contained within the PADtag processes the request and formats a message to be transmitted over the wireless network to the web application. The format of the response is shown below: 10/22/2003 0:04:00, "24026143", 10/21/2003 22:30:00,40.77,74–76, "RMC, 223000,A,4046.4557,N,07445.7861,W,0.0,80.9,211003, 12.9,W*70|T10"

The data in the message is comma delimited and contains the following elements:

Arrival time, PIN Code (from the wireless carrier), UTC (universal time stamp) Longitude, Latitude and GPMRC data.

Figure 11:
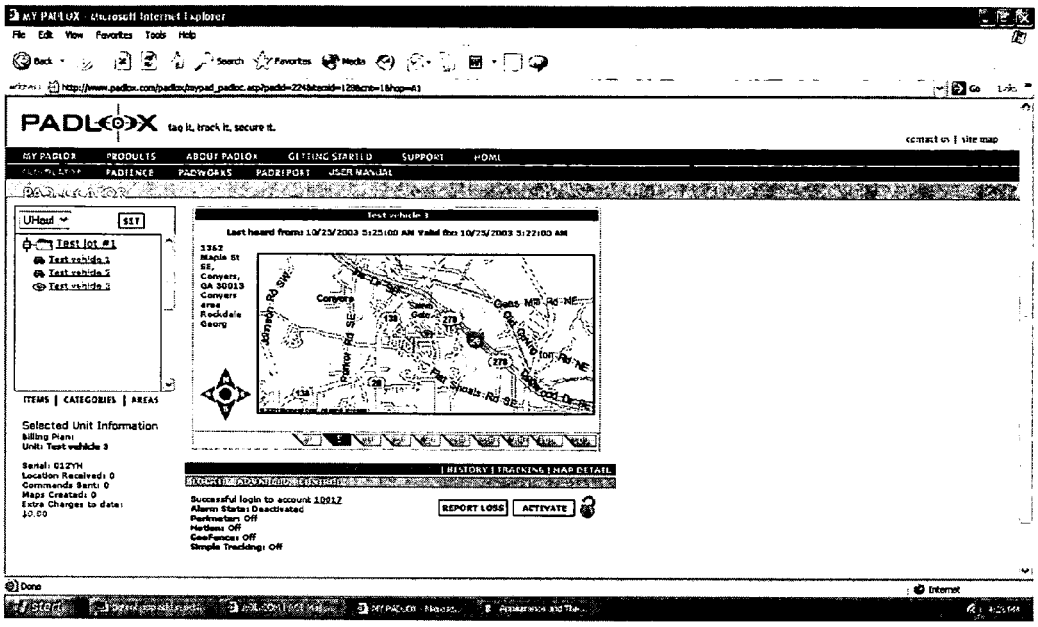
FIG. 11 illustrates a computer display screen displated in response to a LOCATE request in accordance with the invention.

The PADlox web based application processes the structured message and creates the map display that is shown in FIG. 11.

The PADlox system provides the ability to establish an electronic geographic boundary area. The PADlox firmware, resident the PADtag on each protected item in combination with the web-based application PADworks supports three distinct types of geographic boundaries:

1. Perimeter: This geographic boundary is a circle centered about either the present physical location of a protected item, or the place of principle location of the protected item. The user has a choice of the radius of the circle of the perimeter boundary.
2. Speed: This variant of the perimeter boundary treats the speed of the vehicle the same way that it treats a perimeter boundary.
3. Geofencing: This geographic boundary is concerned with monitoring a protected item based upon a predefined, universally accepted geometry. PADlox provides two levels of predefined geographies: the contiguous 48 United States, and the counties within each of the 48 states. The selection of the geographic boundary is a visual selection from a map of the United States. The user can select a specific state (within the United States) and if desired, select a specific county within that state.

From a functional point of view, that is independent of the type of geographic boundary that is selected, PADlox can support the following:

Exit alert: An exit alert is activated when a protected item moves from the defined center or point within the interior of a geographic boundary toward the perimeter of the boundary.

Entrance alert: An entrance alert is activated when a protected item moves from a point exterior to a defined geographic boundary and crosses that boundary inward toward an interior point within the defined boundary.

Speed alert: A speed alert is activated when a protected item's speed exceeds the predefined speed of the alert. The direction of the movement of the protected item is not relevant for this type of alert.

The actions that can be initiated by a breach of any of the types of alerts (exit, entrance and speed) are identical. They are the following:

Telephone call: PADlox can place a telephone call to as many previously defined persons or entities as desired.

Email: PADlox can send an email to as many previously defined persons or entities as desired.

Fax: PADlox can send a fax to as many previously defined persons or entities as desired.

Page: PADlox can send a page to as many previously defined persons or entities as desired.

The type of alert actions (telephone, email, fax or page) can also be mixed. That is PAD/ x can send any combination of the available alert actions.

It is the PADfence bar that appears above the map display that allows the user to set up the PADlox system for any of the available geographic boundaries that are supported.

To use the PADfence capability of the PADlox system, select the PADFENCE tab in the upper left portion of the screen. Selecting the PADFENCE tab will bring up the display shown in FIG. 12.

Figure 12:
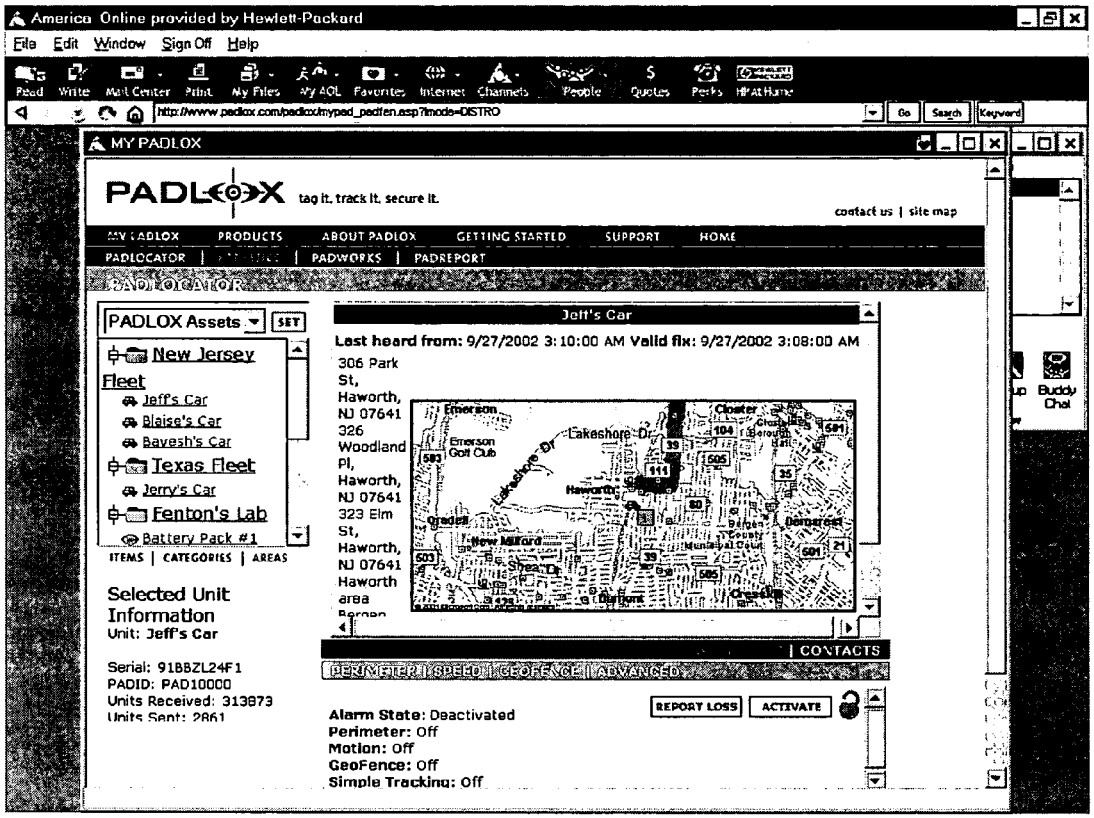
FIG. 12 illustrates a computer display screen displayed in response to a PADFENCE selection.

Beneath the red bar under the map of FIG. 12 are tabs for the three types of PADfences that are supported by the PADlox system. A particular type of PADfence by clicking on the appropriate tab: PERIMETER, SPEED or GEOFENCING.

Figure 13:
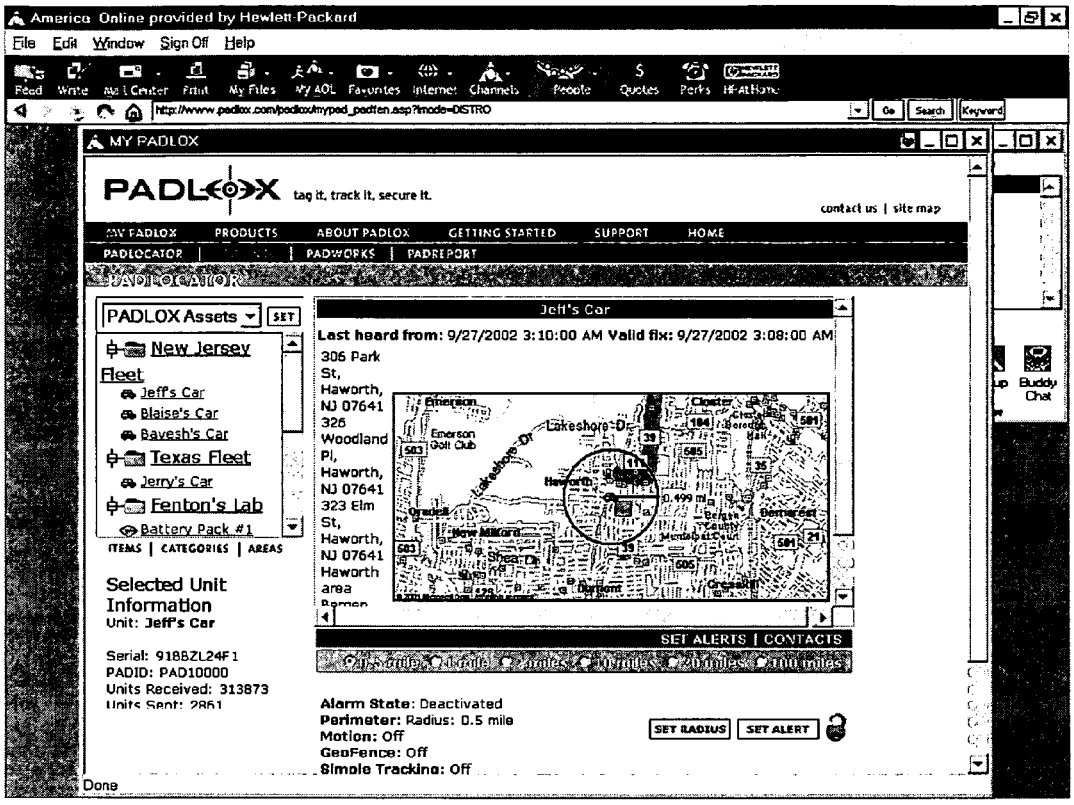
FIG. 13 illustrates a computer display screen displayed in response to a PERIMETER bar selection during establishment of a PADFENCE in acordance with the invention.

To set and activate a Perimeter PADfence, click on the PERIMETER bar on the left side under the map. This will bring up the display of FIG. 13. (NOTE: there are two variants of the PERIMETER PADfence: inward from the exterior of the boundary and outward from the interior toward the defined perimeter. The illustration of FIG. 13 is for the movement outward from the interior toward the defined perimeter. All of the available PADfences can work in either direction. The direction is set from the web site by the user.)

Figure 14:
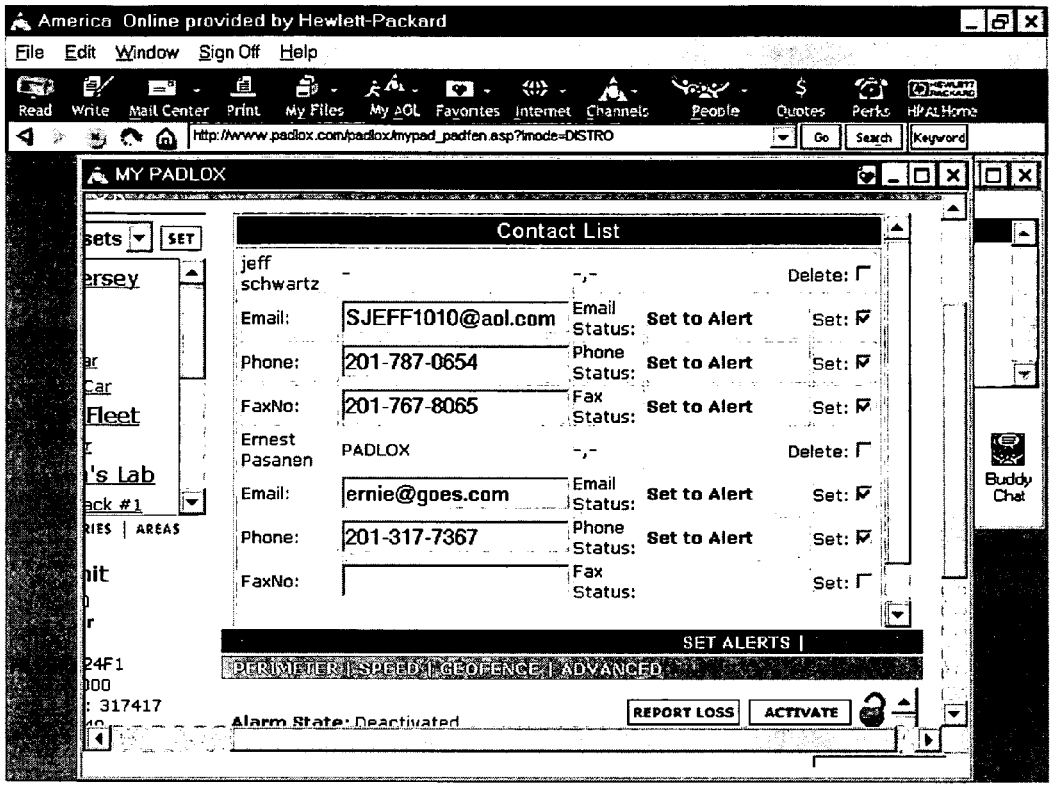
FIG. 14 illustrates a computer display screen displayed in response to a SET ALERT command during establishment of a PADFENCE.

First, select the radius of your Perimeter PADfence by clicking on the choices provided: 0.5 miles, 1 mile, 2 miles, 10 miles, 20 miles or 100 miles. After highlighting the radius, click on the SET RADIUS button located on the right side of the display under the map. The will provide a display, shown in FIG. 13 with a circle appearing around the present location of the item. Finally, click on SET ALERT button provided under the map on the right side of the screen. This will allow the display of FIG. 14 to appear command string that is sent to the PADtag for the perimeter alert is the following:

*AFnnmetpppppdllll.llll,d,LLLL.LLLL,D

Where:

*=this is an over the air command

A=Alert command

F=is the perimeter "fence" command nn=the alarm "slot" that you are using (0–23)

m=mode e=enable=1, disable=0 t=toggle the alert, 1=on. 0=off ppppp is the perimeter radius, expressed in decimal miles (or km)

d=use default timer setting when a "d" is here. "0" for no default timer setting.

If "L", use local GPS information, or else llll.llll,d,LLLL.LLLL,D=optional latitude information (format the same as GPRMC,include commas and decimal points) where:

llll.llll=Latitude in degrees, minutes d=direction (N or S)

LLLL.LLLL=Longitude in degrees, minutes

D=direction (E or W)

Figure 15:
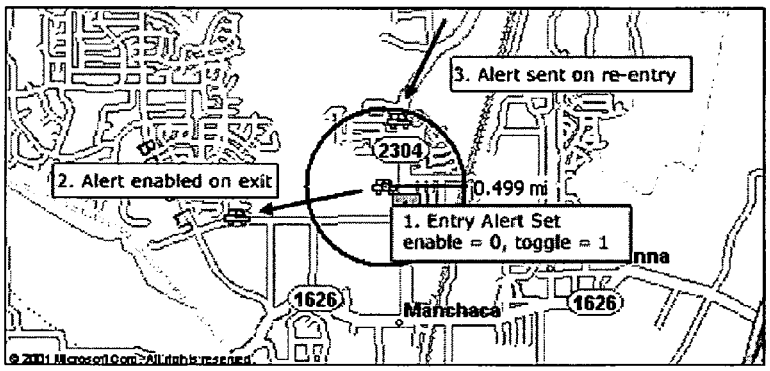
FIG. 15 illustrates a computer display screen displaying a scenario set in accordance with a given command during establishment of a PADFENCE.

The following command will set the scenario depicted in FIG. 15.

*AF0211010.50L

The *AF command does not require the longitude or latitude of the item to be sent to it. If left off, it takes its current position off of the GPS and loads that into the alert object (in this case, slot 02).The "mode" is set to ALERT_PERIMETER_ENTER=1. The "enable" bit is set to 0, and toggle set to 1. A perimeter radius of 0.5 miles is sent. (The coordinates of the alert are immediately sent back to the server system).

The alert remains off until the vehicle moves beyond the 0.5 mile boundary. Once this happens, the PADtag will immediately enable itself. The alert will then only be transmitted once the vehicle re-enters the alert perimeter.

The alert remains active, so it can be maintained continuously so that when a truck returns to a garage in the evening, this information is noted and recorded.

Figure 16:
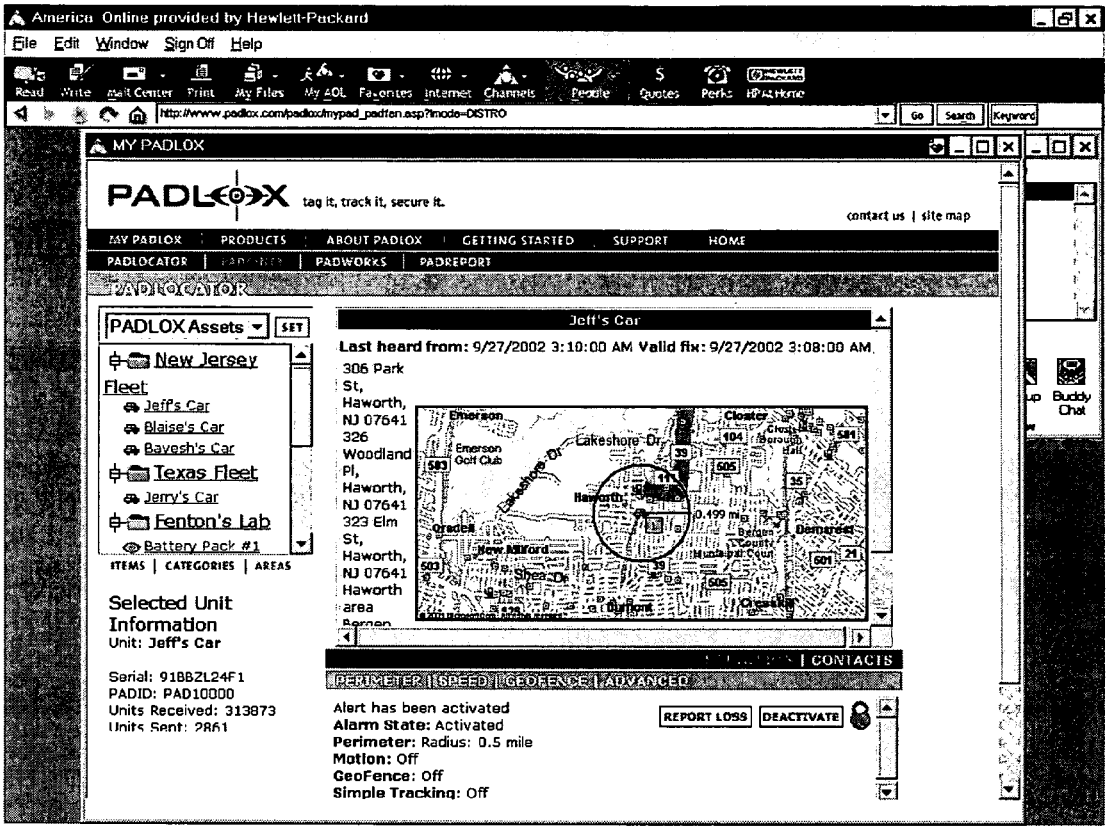
FIG. 16 illustrates a computer display screen displayed in response to a ACTIVATE command during establishment of a PADFENCE.

Using this screen, the user can select the people on apersonalized Contact List to be notified in the event the Perimeter PADfence is violated. The Contact List provides a line for each type of alert delivery (i.e. email, phone or fax) that can apply to each contact. Click on the box to the right of SET, for each alert delivery for each contact. On the screen above, three alert delivery methods have been SET for Jeff Schwartz—and the phone and email alert for Ernest Pasanen. When the alerts have been set on the Alert Contact list, click on the ACTIVATE button located in the lower right corner of the display. Clicking on the ACTIVATE will bring up the screen of FIG. 16.

Figure 17:
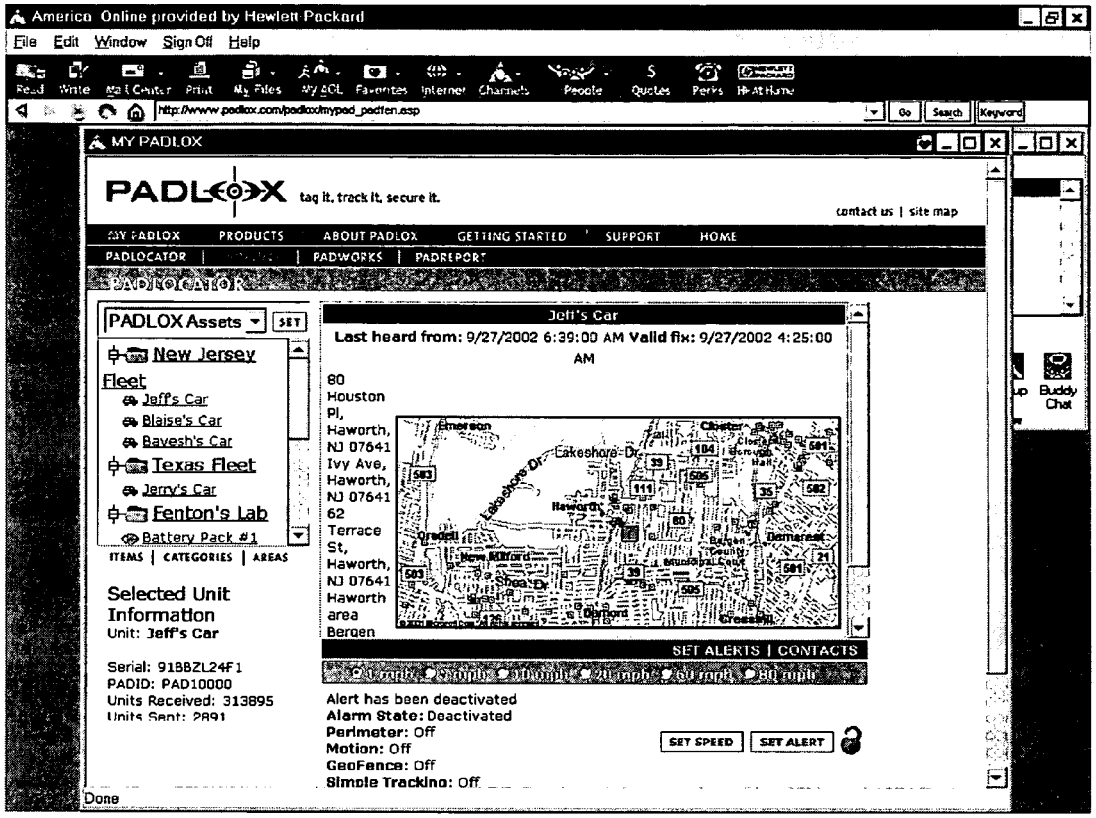
FIG. 17 illustrates a computer display screen displayed in response to a DEACTIVATE command after establishment of a PADFENCE.

The display above illustrates that a Perimeter PADfence with a radius of 0.5 mile from the current location of the item has been set, and that the PADfence has been activated. The activated state of the PADfence is also shown by the lock icon appearing under the map on the right side, with the shackle closed. The Perimeter PADfence can be deactivated by clicking on the DEACTIVATE button on the lower right side of the display. This result of this action is shown in FIG. 17.

At this point, the Perimeter PADfence has been deactivated.

Figure 18:
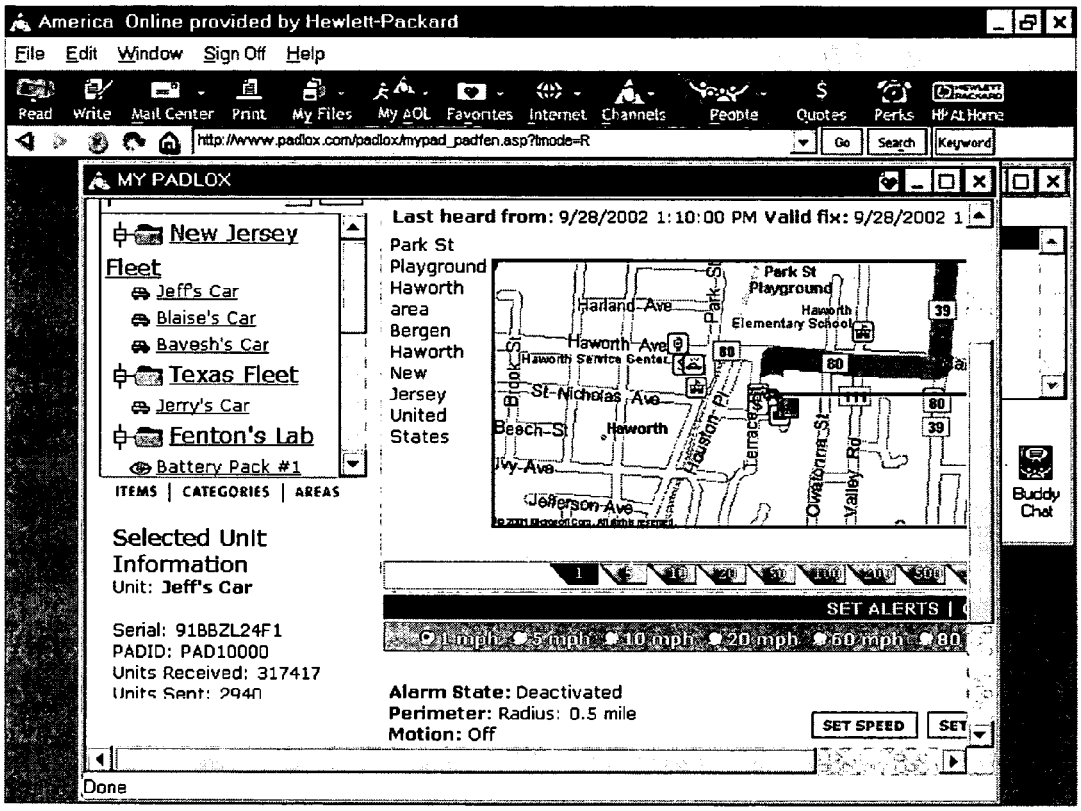
FIG. 18 illustrates a computer display screen displayed in response to a PADFENCE command in order to activate a speed PADfence in accordance with the invention.

To set and activate a Speed PADfence, click on the PADFENCE bar on the upper left side of above the map. This will bring up the display of FIG. 18.

Figure 19:
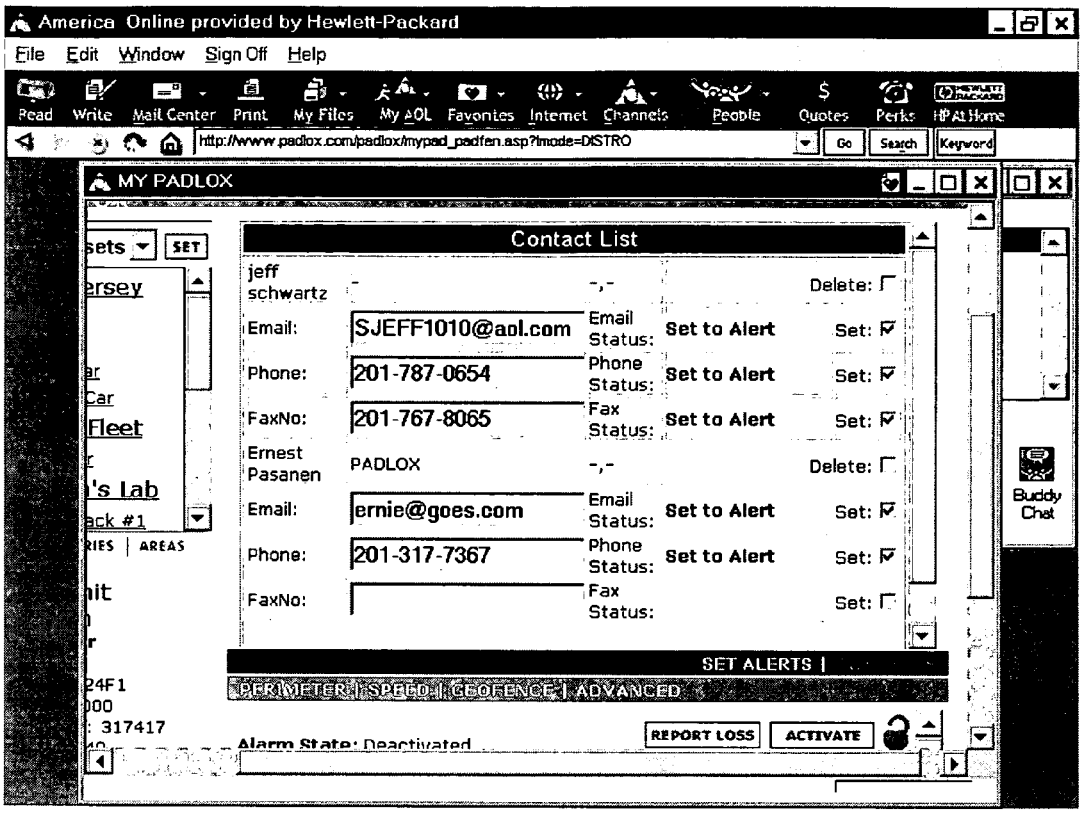
FIG. 19 illustrates a computer display screen displayed in response to a SET SPEED command during establishment of a speed PADFENCE.

The speed PADfence can now be activated. Select the speed at which the PADfence to alert the members of the contact list is to activate. Next, click on the SET SPEED button located on the lower right side of the display under the map. After setting the speed, click on SET ALERTS button located on the lower right side of the display, under the map. The screen of FIG. 19 will then appear.

Using this screen, the people on the Contact List to be notified in the event the Speed PADfence is violated are selected . The Contact List provides a line for each type of alert delivery (i.e. email, phone or fax) that can apply to each contact. Click on the box to the right of SET, for each alert delivery for each contact. On the screen illustrated, three alert delivery methods have been SET for Jeff Schwartz—and the phone and email alerts for Ernest Pasanen. When the alerts have been set on the Alert Contact list, click on the ACTIVATE button located in the lower right corner of the display. Clicking on the ACTIVATE will bring up the screen shown in FIG. 20. The command string that is sent to the PADtag for the speed alert is the following:

*ASnnmetsss

Where:

*=this is an over the air command
A=Alert command
M=miscellaneous commands
nn=the alarm "slot" that you are using (0–23)
m=mode
e=enable=1, disable=0
t=toggle the alert, 1=on. 0=off
ssssss=Max speed. Exceeding this speed will trip alert

*AS09311060 will send an alert each time the vehicles speed exceeds 60 miles per hour.

Figure 20:
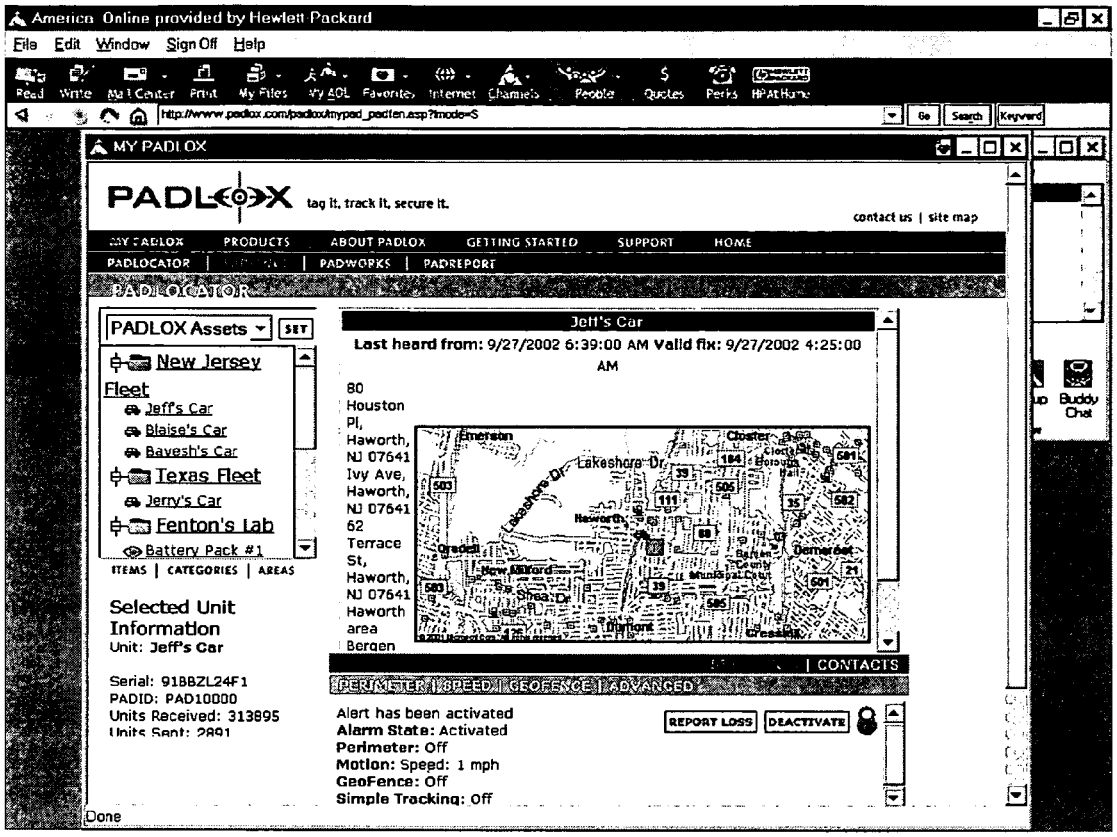
FIG. 20 illustrates a computer display screen displayed in response to the speed parameters selected during establishment of a speed PADFENCE.
Figure 21:
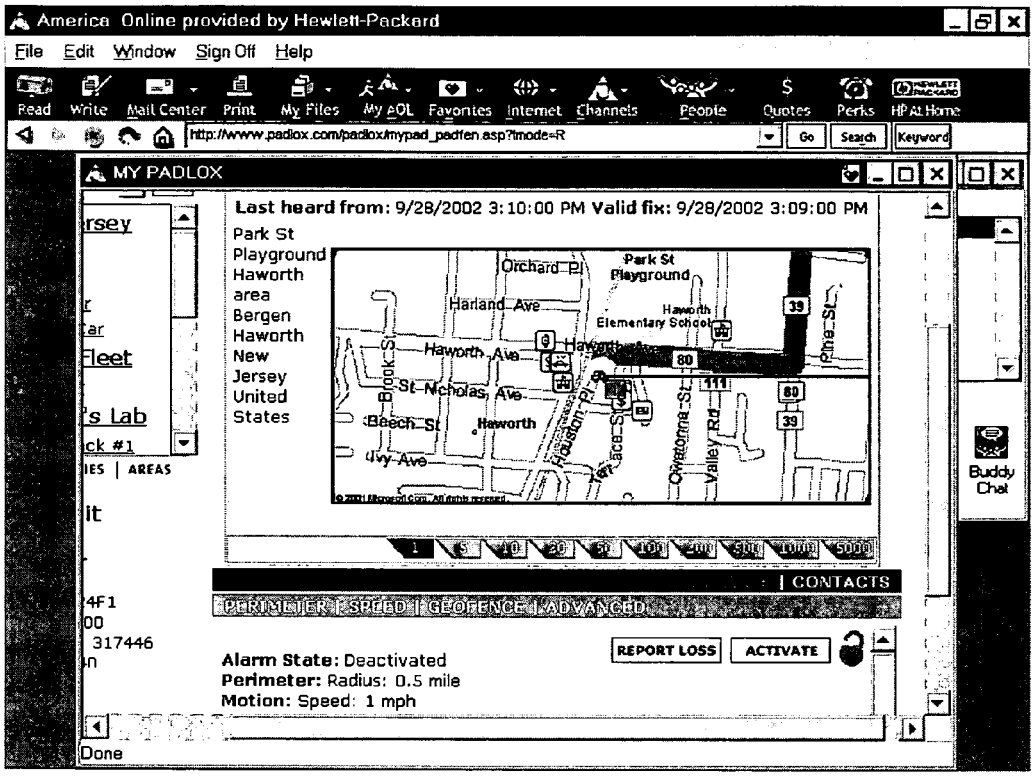
FIG. 21 illustrates a computer display screen displayed in response to a DEACTIVATE command after establishment of a speed PADfence.

FIG. 20 illustrates that a Speed PADfence with a speed of 1 mile per hour has been set, and that the PADfence has been activated. The activated state of the PADfence is also shown by the lock icon appearing under the map on the right side, with the shackle closed. The Speed PADfence may be deactivated by clicking on the DEACTIVATE button on the lower right side of the display. This result of this action is shown in FIG. 21.

The geofencing option is set and activated in the exact same manner as the perimeter PADfence. The appropriate predefined geographic boundary, either state or country with state is selected, and the appropriate entities on the contact list are identified. In the event the PADfence is breached, messages will be delivered to the entities identified from the list of available contacts.

Further Qualifying the Use of a PADfence:

As shown, each type of PADfence can be operated in a bidirectional manner: either inward or outward. The PADfence can be further refined by using available timers with the PADtag firmware. The timers allow a PADfence to have window of operation beginning at a specified time and ending at another specified time. The is communicated to the PADtag by the following command: A timer can be in one of the following states:

| Time Function | # |
|---|---|
| DISABLE_TIME | 0 |
| DELTA_TIME | 1 |
| ABSOLUTE_TIME | 2 |
| ONE_TIME | 3 |

All timer commands begin with a "T" To set the basic timer, use the following command

*TMnnme

Where:

*=this is an over the air command
T=Timer command
M=miscellaneous commands
nn=the timer "slot" that you are using (0–31)
m=mode
e=enable=1, disable=0
d=default. If=1, set timer to defaults The following command:

*TM0011

. . . sets the timer function to DELTA_TIME and enables it. If the default settings are not changed, 10 location transmissions are sent at intervals of every 5 minutes.

*TM0131 sets the timer to ONE_TIME. This will immediately fire the timer once and reset it. This is usually used in conjunction with alerts.

PADTAG Delta or Interval Timers

To actually change the values the timer will actually use, issue the following command:

*TDnneiiiiicccc

Where:

*=this is an over the air command
T=Timer command
D=repeat at fixed intervals (delta time) command
nn=the timer "slot" that you are using (0–31)
e=enable=1, disable=0
d=delay first response, 1=delay, 0=respond and then count
iiiii=interval in seconds between transmissions
cccc=total number of transmissions before stopping, all zeros=continuous

*TD0110006000010 will send a location transmission every 600 seconds (10 minutes) and will do so 10 times. Delay=0, so the first event will not be sent until after the first 10 minutes elapse.

PADTAG Absolute or Scheduled Timers

Sometimes it is desired to have an event take place at a specific time every day, like at noon or midnight. The following command takes care of that:

*TAnnethhmmwwMMDDYYcccc

Where:

*=this is an over the air command
T=Timer command
A=Absolute time
nn=the timer "slot" that you are using (0–31)
e=enable=1, disable=0
t=toggle=1, no toggle=0
hh=two digit hour, or ??
mm=two digit minute, or ??
ww=two digit day of week, or ?? (Sunday=00, Saturday=06)
MM=two digit month, or ??
DD=two digit day, or ??
YY=two digit year, or ??
cccc=optional maximum number of transmissions, all zeros=continuous

*TA021102359??????????0010 will fire the timer every day at midnight (23:59 hours) and will do so 10 times. The question marks are wildcard characters that mean "any value".

*TA0211020001 ??????0100 will fire the timer at noon, every Monday.

*TA03111????????01?? will fire the timer off the first day of every month, at midnight, continuously.

An absolute timer event will fire once, and then reset when the masked time becomes "not true". The "toggle" switch will set it for the next instance, if desired.

A PADtag internally is set to Greenwich Mean Time, or Universal Coordinated Time (UTC). An addition or subtraction of the appropriate number of hours to is required to use the local time.

The invention thus provides a sysytem that can be used to locate a lost or stolen article as well as to use the article to obtain recovery of the article.

The invention also provides a system that can be usedto track a stolen article or an article that requires tracking to ensure that the article has not detoured from a given path.

What is claimed is:

1. A system for protecting an article comprising the steps of affixing an electronic tag to the article characteristic of the article, said tag including a wireless transceiver for communication over a communications network a GPS receiver to receiving location related information from a global positioning system, a microprocessor for performing on board calculations and transferring data from said GPS receiver to said transceiver and firmware in said microprocessor for processing instructions for operation of said transceiver, said GPS receiver and said microprocessor and for communicating with the communications network;

delivering an electronic signal from a remote location via a global positioning system to said transceiver on the article to activate said tag to receive location related information from the global positiong system and to emit a signal directly from said GPS receiver indicative of the location of the article to said remote location; and providing a FLASH memory within said electronic tag for tracking the location of the article over a period of time and delivering corresponding information from said firmware to said remote location to display the path of travel of the article over time on a map at said remote location.

2. A system as set forth in claim 1 further comprising the steps of providing a motion detector in said electronic tag for detecting motion of the article and establishing an electronic geographic boundary area about the article and emitting a signal from said tag in response to the article passing beyond said boundary.

3. A system as set forth in claim 2 further comprising the step of employing said emitted signal from said tag to disable movement of the article upon passing from said geographic boundary area.

4. An asset management and protection system comprising a PADworks software component containing an inventory of disparate artides, a HISTORY function to record a time sequence of the movement of a selected article and a LOCATE function to locate a selected article of said inventory; and a plurality of PADtag components, each said PADtag component containing information characteristic of a selected article of said inventory and affixed to said selected article, each said PADtag including a wireless transceiver for communication over a communications network with said PADworks software component a GPS receiver for receiving location related information from a global positioning system, a microprocessor for performing on board calculations and transferring data from said GPS receiver to said transceiver, firmware in said microprocessor for processing instructions for operation of said transceiver, said GPS receiver and said microprocessor and for communicating with said PADworks software component over the communications network, and a FLASH memory for tracking the location of the article over a period of time and delivering corresponding information to said PADworks software component to display the path of travel of the article over times on a map.

5. A system as set forth in claim 4 wherein said microprocessor is a Rabbit 3000 series processor.

6. A system as set forth in claim 4 wherein said firmware has a plurality of ALERTS for monitoring a plurality of events and emitting a responsive signal through said transceiver indicative of the occurrence of at feast one of said events.

7. A system as set forth in claim 6 wherein said firmware has a plurality of timers, each said timer being connected with a respective one of said ALERTS to be set thereby in response to an output from said respective ALERT, each said timer being programmed to effect transmission of a signal from said PADtag to said PADworks software component over the communications network indicative of the respective ALERT.

8. A system as set forth in claim 7 wherein said respective ALERT is an ALERT_PERIMETER_ENTER for indicating when an article enters a preset perimeter.

9. A system as set forth in claim 7 wherein said respective ALERT is an ALERT_PERIMETER_EXIT for indicating when an article exits a geographic perimeter.

10. A system as set forth in claim 7 wherein said respective ALERT is an ALERT_SPEED for indicating when an article exceeds a preset speed.

11. A system as set forth in claim 7 wherein said respective ALERT is an ALERT_ODOMETER for indicating when an odometer on the article exceeds a preset value.

12. A system as set forth in claim 7 wherein said respective ALERT is an ALERT_TRIPMETER for Indicating when a trip meter on the article exceeds a preset value.

13. A system as set forth in claim 1 wherein said firmware has a PADfence algorithm for sensing at least one of movement of a selected article over a predetermined speed limit, movement of a selected article from a predetermined position and movement of a selected article beyond the boundary of a predetermined geographic area.

14. An asset management and protection system comprising a PADworks software component containing art inventory of disparate articles and a LOCATE function to locate a selected article of said inventory; and a plurality of PADtag components, each said PADtag component containing information characteristic of a selected article of said inventory and affixed to said selected article, each said PADtag including a wireless transceiver for communication over a communications network with said PADworks software component, a GPS receiver for receiving location related information from a global positioning system, a microprocessor for performing on board calculations and transferring data from said GPS receiver to said transceiver and firmware in said microprocessor for processing instructions for operation of said transceiver, said GPS receiver and said microprocessor and for communicating with said PADworks software component over the communications network, said firmware having a plurality of ALERTS for monitoring a plurality of events and emitting a responsive signal through said transceiver indicative of the occurrence of at least one of said events and a plurality of timers, each said timer being connected with a respective one of said ALERTS to be set thereby in response to an output from said respective ALERT, each said timer being programmed to effect transmission of a signal from said PADtag to said PADworks software component over the communications network indicative of the respective ALERT.

* * * * *

UNITED STATES PATENT AND TRADEMARK OFFICE

CERTIFICATE OF CORRECTION

PATENT NO. : 7,138,916 B2
APPLICATION NO. : 10/696296
DATED : November 21, 2006
INVENTOR(S) : Jeffrey Schwartz It is certified that error appears in the above-identified patent and that said Letters Patent is hereby corrected as shown below:

Column 3
Line 4, "PAD*1*ox" should be -- PADlox --

Column 27
Line 16, "network a" should be -- network, a --
Line 17 "to" should be -- for --
Line 52 "artides" should be -- articles --

Column 28
Line 9 "times" should be -- time --
Line 15 "feast" should be -- least --
Line 39 "Indicating" should be -- indicating --
Line 49 "art" should be -- an --

Signed and Sealed this

Sixth Day of February, 2007

JON W. DUDAS
*Director of the United States Patent and Trademark Office*